US007338310B2

(12) United States Patent
Kumakura

(10) Patent No.: US 7,338,310 B2
(45) Date of Patent: Mar. 4, 2008

(54) PIERCING TERMINAL AND CONNECTOR USING SAME

(75) Inventor: Hideto Kumakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/384,383

(22) Filed: Mar. 21, 2006

(65) Prior Publication Data

US 2006/0286848 A1 Dec. 21, 2006

(30) Foreign Application Priority Data

May 27, 2005 (JP) ..... 2005-155750

(51) Int. Cl.
*H01R 4/24* (2006.01)

(52) U.S. Cl. ..... 439/422

(58) Field of Classification Search ..... 439/422, 439/423, 874

See application file for complete search history.

(56) References Cited

U.S. PATENT DOCUMENTS

| | | | | |
|---|---|---|---|---|
| 3,197,729 A | | 7/1965 | Sarazen | 339/97 |
| 3,395,381 A | * | 7/1968 | Huffnagle | 439/422 |
| 3,950,070 A | * | 4/1976 | Groft et al. | 439/422 |
| 3,997,233 A | * | 12/1976 | Evans | 439/422 |
| 4,357,065 A | | 11/1982 | Kam et al. | 339/97 R |
| 4,561,714 A | | 12/1985 | Byczek et al. | 339/97 P |
| 4,564,253 A | * | 1/1986 | Sinclair | 439/422 |
| 4,669,798 A | | 6/1987 | Daum et al. | 439/423 |
| 6,068,505 A | * | 5/2000 | Sai | 439/422 |
| 6,267,618 B1 | * | 7/2001 | Hio | 439/422 |
| 6,375,492 B1 | * | 4/2002 | Hio | 439/422 |
| 6,746,269 B1 | * | 6/2004 | Casses | 439/422 |
| 2004/0063351 A1 | * | 4/2004 | Enomoto et al. | 439/422 |

FOREIGN PATENT DOCUMENTS

| | | |
|---|---|---|
| JP | 7-245129 | 9/1995 |
| JP | 2549583 | 6/1997 |
| JP | 2002-334617 | 11/2002 |

* cited by examiner

*Primary Examiner*—Tulsidas C. Patel
*Assistant Examiner*—Vladimir Imas
(74) *Attorney, Agent, or Firm*—Kratz, Quintos & Hanson, LLP

(57) ABSTRACT

A piercing terminal having electric connection with a conductor of a flat circuit body such as a flexible flat cable (FFC) and a connector utilizing the same. The connector includes multiple piercing terminals and a connector housing. Each piercing terminal has an elongated tube having a lengthwise direction for alignment with a lengthwise direction of the conductor, and crimp edges for crimping the conductor of the FFC. The crimp edges protrude outwardly in a direction perpendicular to the lengthwise direction from an outer surface of the tube. The connector housing has terminal receiving rooms for receiving the piercing terminals and a FFC receiving room for receiving the FFC crimped with the piercing terminals.

8 Claims, 23 Drawing Sheets

PIERCING TERMINAL AND CONNECTOR USING SAME

BACKGROUND OF THE INVENTION

1. Field of the Invention

The present invention relates to a piercing terminal which penetrates into a flat circuit body such as FPC (Flexible Print Circuit) or FFC (Flexible Flat Cable) for electrically connecting with a conductor thereof, and relates to a connector having the piercing terminal.

2. Description of the Related Art

A vehicle has a variety of electronic devices. Electric power from a battery and signals from control devices are transmitted to the electronic devices through a wiring harness. The wiring harness has a FFC 50 and a connector 51 connected with the FFC 50 as shown in FIGS. 20A and 20B. For example, refer to JP,2002-334617,A or JP,2549583,Y.

The FFC 50 includes a plurality of conductors 52 juxtaposed to each other and an insulating sheath 53 for insulating the conductors 52 each other. The conductors 52 are made of a copper alloy such as brass and are conductive. The insulating sheath 53 is formed with PET(Polyethylene-terephthalate).

An end portion of the FFC 50, which is received in a connector housing 56 of the connector 51 as described later, has a cutout portion 54 which is positioned between the conductors 52. As shown in FIG. 21A, the cutout portion 54 is shaped to be fitted with a shape of the connector housing 56. The cutout portion 54 is disposed between the conductors 52.

The connector 51 has a female terminal (hereafter called terminal) 55 and the connector housing 56. As shown in FIGS. 20B and 21A, the terminal 55 has the conductors 52 of the FFC 50, a wire connecting portion 58, and an electric contact portion 59 connected with the wire connecting portion 58. The wire connecting portion 58 has a bottom wall 60*a* and crimp edges 61 upstanding from the bottom wall 60*a*.

As shown in FIG. 21B, the crimp edges 61 penetrate through the conductors 52 and the insulating sheath 53, and crimp the FFC 50. Accordingly, the crimp edges 61 are electrically connected with the conductors 52 of the FFC 50.

Each electric contact portion 59 has a bottom wall 60*b* connected with the bottom wall 60*a* of the wire connecting portion 58. The electric contact portion 59 accepts a strip-shaped male tab (not shown) and is electrically connected with the male tab. The terminals 55 are received in the connector housing 56 and are fitted with the male terminals so that the conductors 52 of the FFC 50 and the male terminals are electrically connected.

The connector housing 56 has a tube-shaped main body 63 and a retainer 64 to be attached to the main body 63. The main body 63 has a partition 65 which separates the main body 63 into a plurality of terminal receiving rooms 66. The cutout portion 54 is positioned to the partition 65 and the terminal receiving rooms receive the terminals 55.

An end portion of the retainer 64 is received in the main body 63 so as to press the FFC 50 connected to the terminals 55. Accordingly, the connector housing 56 positions the cutout portion 54 to the partition 65 and receives the end of the FFC 50 crimped to the terminals 55 with the crimp edges 61 in the terminal receiving room 66.

The connector housing 57 of FIG. 22 has the tube-shaped main body 63 and slits 67 disposed in the main body 63. The slits 67 are formed in the main body 63 to correspond to a shape of the FFC 50 and extend into a longitudinal direction of the main body 63 and receive the end portion of the FFC 50 crimped to the terminals 55. The connector housing 56 having the terminals 55 is fitted into a mating connector housing (not shown) receiving male terminals.

In the conventional terminals 55, in order to crimp the FFC 50 to the terminals 55 with the crimp edges 61, each terminal 55 is placed between metal frames 68 and approached to the FFC 50 as shown in FIG. 23A.

The conventional terminal 55 has the upstanding crimp edges 61 at the bottom wall 60*a* so that the terminal 55 becomes longer. In the conventional terminal 55, the electric contact portion 59 extends forwardly from the end portion of the FFC 50 so that the terminal 55 can not be easily handled. In the conventional FFC 50, the cutout portion 54 thereof reduces the strength of the FFC 50.

When the terminal 55 is positioned between the metal frames 68, there often occurs gaps A between inner walls 69 of the metal frames 68 and outer walls 70 of the terminal 55, as shown in FIG. 23A. Accordingly, when the terminal 55 is approached to the FFC 50, the crimp edges 61 incline at an angle of θ corresponding to the gaps A. Namely, the terminal rolls. When the terminal 55 rolls, the crimp edges 61 do not penetrate perpendicularly to the FFC 50.

This causes a clearance between the crimp edges 61 and the FFC 50 when the crimp edges 61 penetrate the FFC 50 and are bent. As a result of that, the electrical connection between the terminal 55 and the conductor 52 of the FFC 50 becomes unstable. In order to avoid the rolling of the crimp edges 61, the length thereof can be made longer. However, the long crimp edges 61 reduces the rigidity and are easily bent when the crimp edges 61 penetrate into the FFC 50.

SUMMARY OF THE INVENTION

The present invention is to provide a piercing terminal having reliable electric connection with a conductor of a flat circuit body.

According to a first aspect of the present invention, a piercing terminal includes a tube; and a crimp edge to be electrically connected to a conductor of a flat circuit body, wherein the crimp edge protrudes outwardly from an outer surface of the tube.

Preferably, the crimp edge is formed by cutting out of the tube and bending from it outwardly.

According to a second aspect of the present invention, a connector includes a connector housing having a terminal receiving room; and a piercing terminal, as claimed in 1 or 2, received in the terminal receiving room.

Preferably, the connector housing includes a main body for receiving the piercing terminal in the terminal receiving room, and a cover to be fitted to the main body and cover the piercing terminal in company with the main body.

Preferably, the cover has a fitting detector which detects an incomplete fitting of the piercing terminal into the terminal receiving room and interferes with the piercing terminal so as to prohibit the fitting.

Preferably, the cover has a double locking portion which prevents the piercing terminal from being pulled out of the terminal receiving room after the cover is fitted into the main body.

Preferably, the connector housing has a flat circuit body receiving room communicating with the terminal receiving room.

DETAILED DESCRIPTION OF THE PREFERRED EMBODIMENTS

Figure 2:
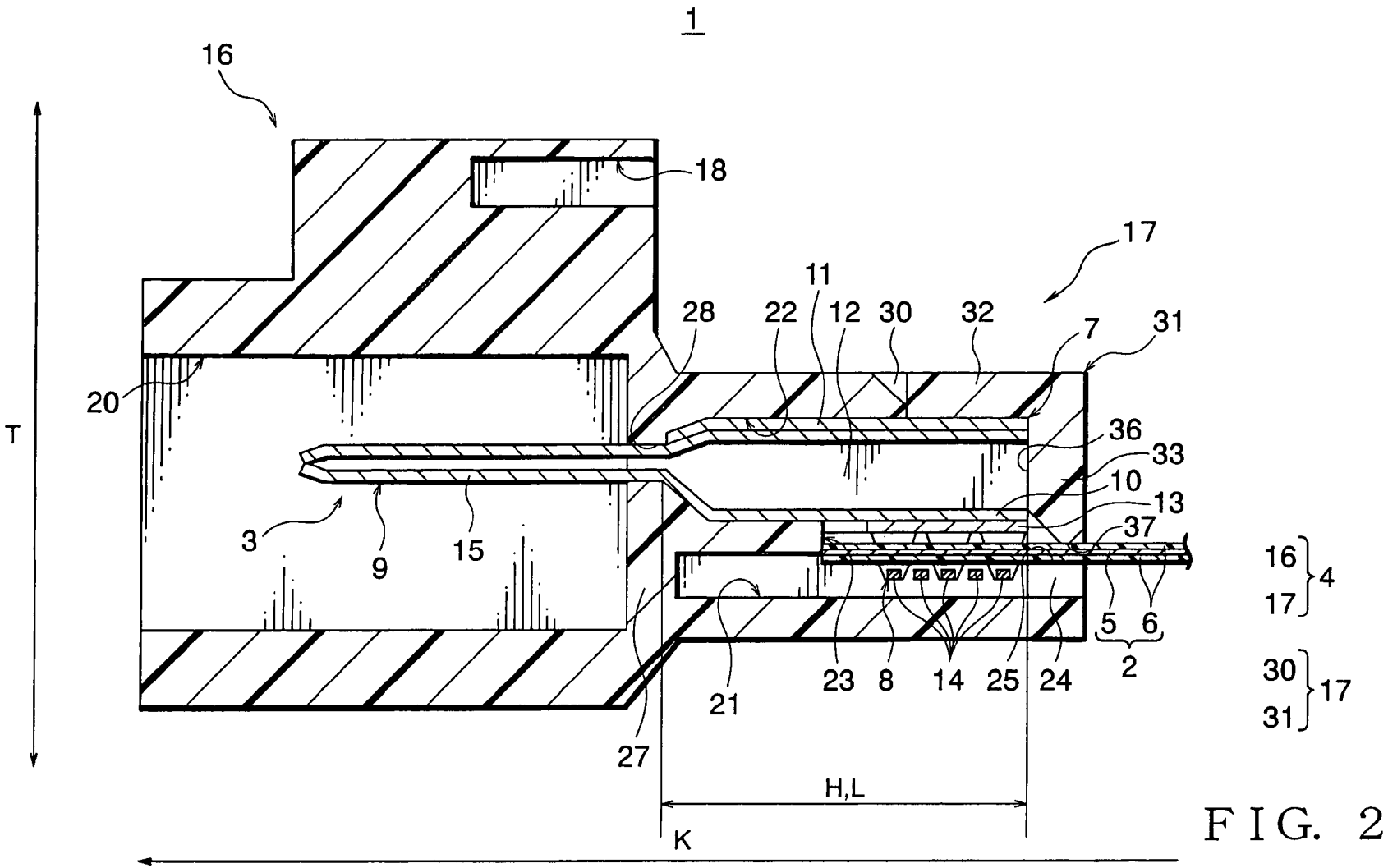
FIG. 2 is a sectional view taken along the line 2-2 of FIG. 1.

An embodiment of a connector of the present invention is explained by referring to drawings 1 to 13. As shown in FIG. 2, a connector 1 includes male piercing terminals 3, hereafter referred to piercing terminal, connected to a flexible flat cable 2, hereafter referred to FFC, and a connector housing 4.

The FFC 2 is a flat circuit body and includes a plurality of conductors 5 and an insulating sheet 6 covering the conductors 5.

The conductors 5 are formed with a conductive metal including at least copper or copper alloy and has a rectangular cross section. The plurality of the conductors 5 are juxtaposed to each other.

The insulating sheet 6 is formed with an insulating synthetic resin such as Polyethyleneterephthalate (PET) and has a belt-shape. The insulating sheet 6 receives and covers the conductors 5.

The piercing terminals 3 are inserted into terminal receiving rooms 22 in the connector housing 4 as indicated by an arrow K, and fitted into female terminals (not shown) of a mating connector so as that the female terminals and the conductors 5 of the FFC 2 are electrically connected.

A mating connector housing (not shown) receiving the female terminals is fitted into a housing receiving room 20 of the connector housing 4. The female terminals each is formed in a tube shape and has a elastic contact piece (not shown) which contacts with a inserting tip 15 of the piercing terminal 3, when the both connectors are fitted together.

Figure 3:
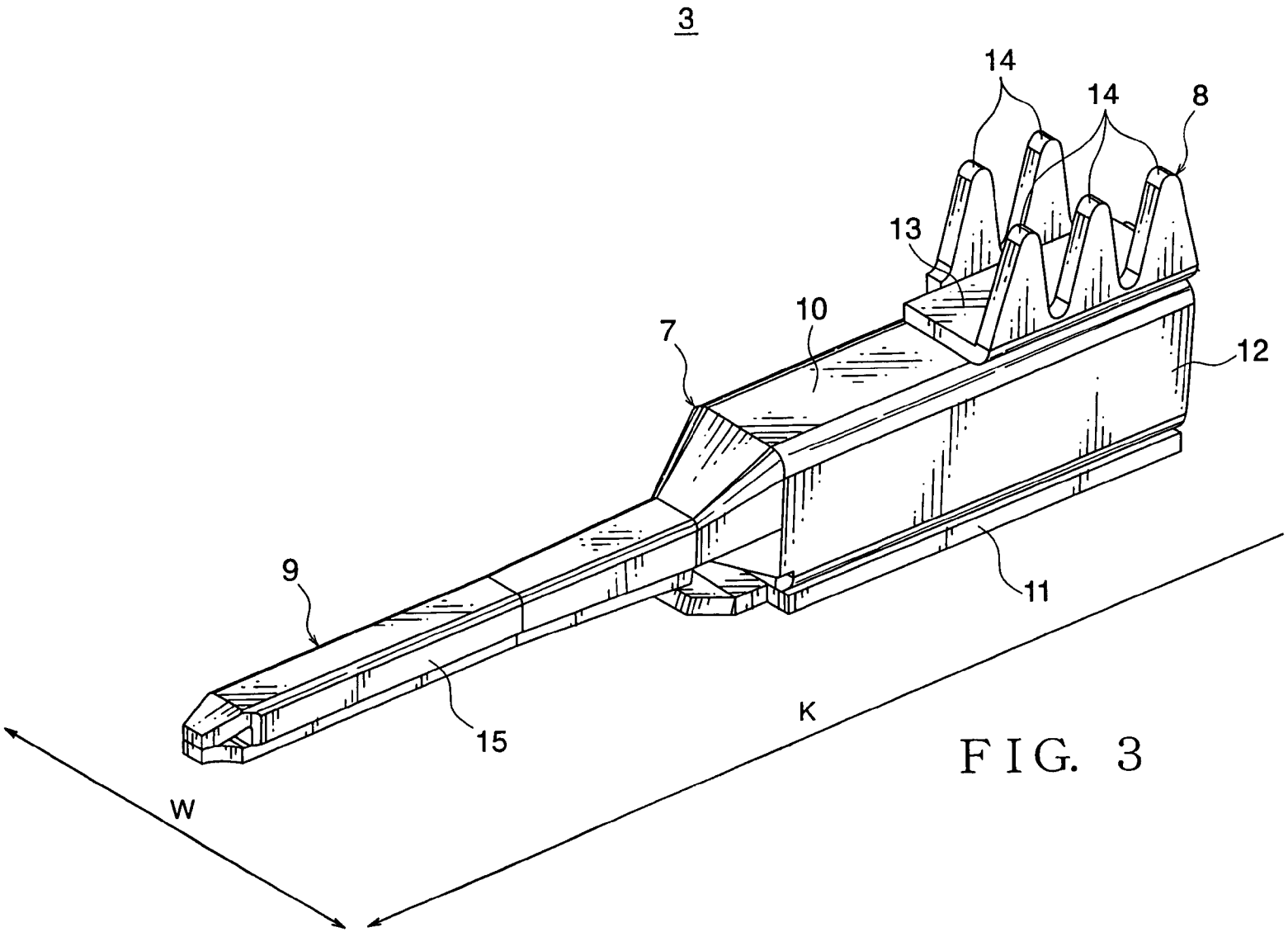
FIG. 3 is a perspective view showing a piercing terminal of the connector shown in FIG. 2.

The piercing terminals 3 are formed by punching and bending a metal sheet. As shown in FIG. 3, the piercing terminals 3 each have a tube 7, a wire connecting portion 8 to be connected to the FFC 2, and an electric contact portion 9 to be connected to the female terminal.

The tube 7 has a bottom wall 10, a top wall 11 opposed to the bottom wall 10, and a pair of side walls 12 connected to the bottom wall 10 and top wall 11. The bottom wall 10 and top wall 11 each have a flat rectangular shape and are disposed parallel to each other. The pair of the side walls 12 are disposed parallel to each other with a distance, or a width of the piercing terminal 3 which is the same width as that of the terminal receiving room 22.

The wire connecting portion 8 has a base plate 13 and crimp edges 14 protruding outwardly from the base plate 13. The base plate 13 has a flat rectangular shape and has the same width as those of the bottom wall 10 and top wall 11. The base plate 13 is formed integrally with the bottom wall 10 and folded to be superimposed onto the bottom wall 10.

As shown in FIG. 3, the crimp edges 14 are disposed at both sides of the base plate 13 along a longitudinal direction thereof (insertion direction K). The crimp edges 14 have a plate shape and are tapered outwardly.

Figure 4:
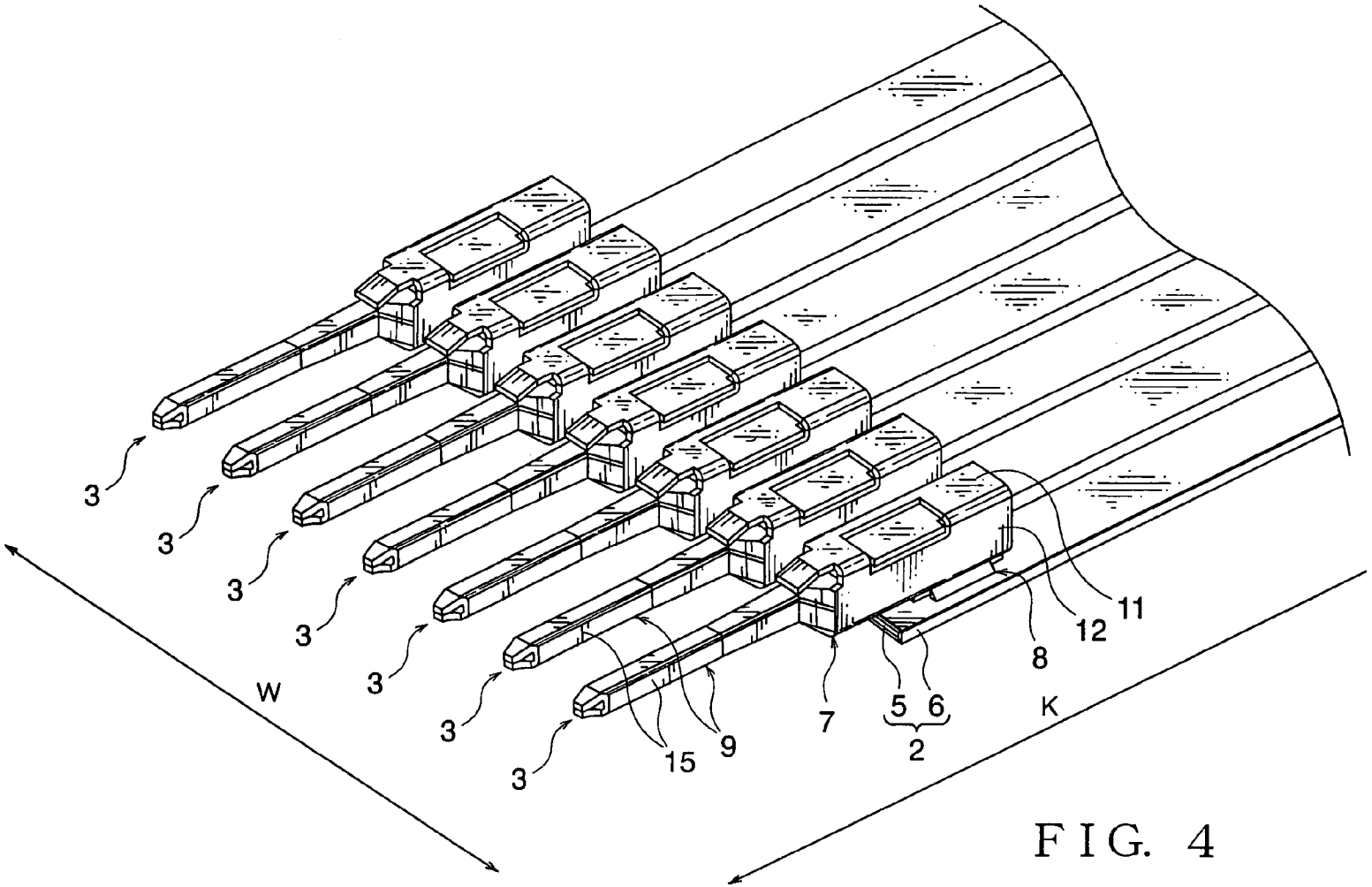
FIG. 4 is a perspective view showing that the piercing terminals of FIG. 3 are electrically connected to conductors of a FFC.

The crimp edges 14 are abutted to the end portion of the FFC 2 disposed parallel to the base plate 13 and penetrate both the conductors 5 and the insulating sheet 6 of the FFC 2 so that end portions of the crimp edges 14 are bent inwardly toward the base plate 13 and are connected electrically to the conductors 5 of the FFC 2 and fixed together with the FFC 2 as shown in FIG. 4.

As shown in FIG. 3, the electric contact portion 9 has the inserting tip 15 to be inserted into the female terminal. One end of the inserting tip 15 is connected with the walls 10, 11, 12 and the other end thereof is tapered like a blade. The inserting tip 15 is inserted into the female terminal along the direction of K and contacts with the elastic contact piece (not shown) in the female terminal.

Figure 1:
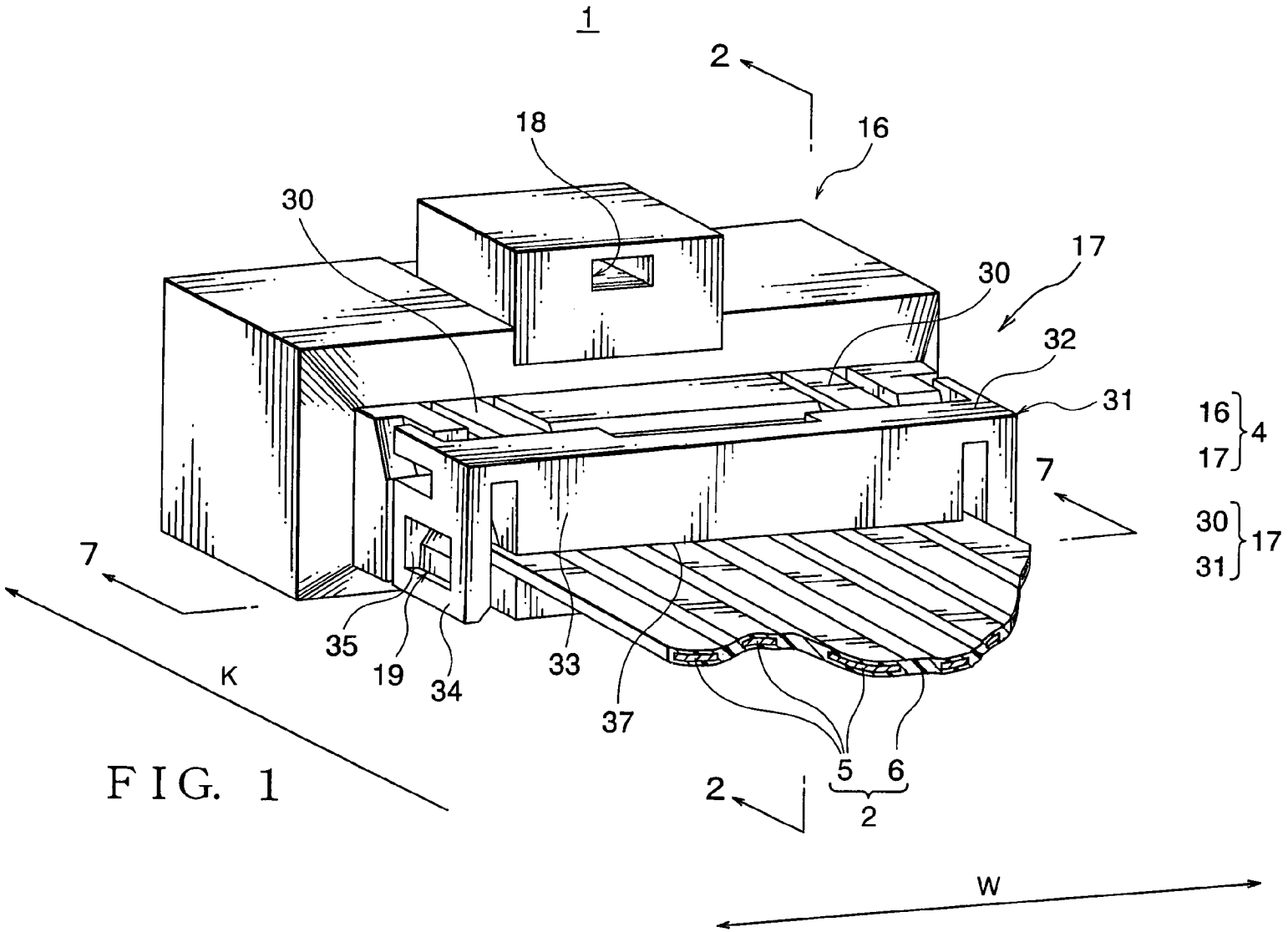
FIG. 1 is a perspective view showing a connector of a first embodiment of the present invention.
Figure 5:
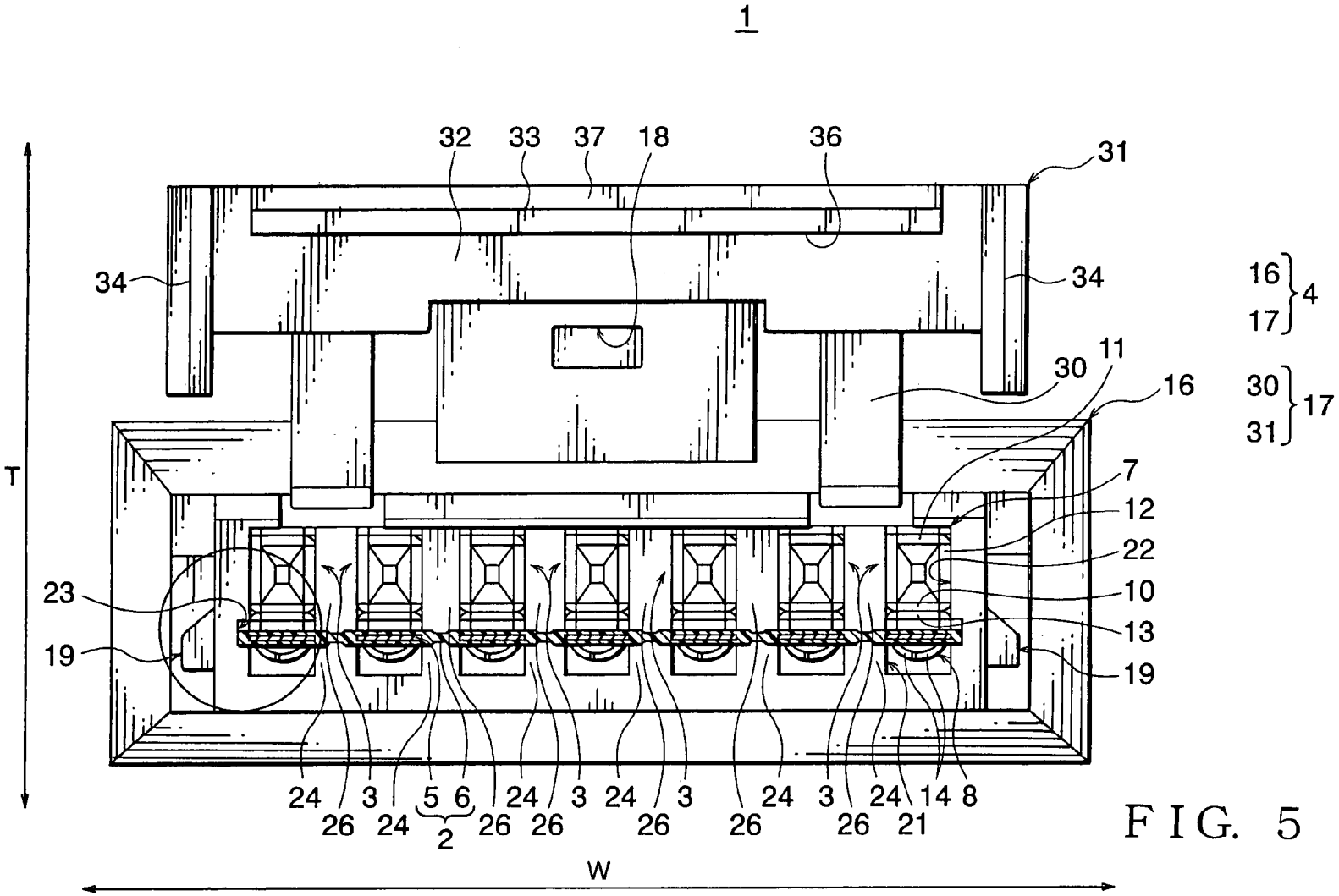
FIG. 5 is a front view showing that the piercing terminals connected with the FFC are inserted into a connector housing of the connector of FIG. 1.

As shown in FIGS. 1, 2 and 5, the box-shaped connector housing 4, which id made of a synthetic resin, includes a main body 16 and a cover 17 to cover the main body 16. The connector housing 4 is fitted into the connector housing of the mating connector (not shown).

The main body 16 includes a locking hole 18, a protrusion 19, the housing receiving room 20, a FFC receiving room 21, and the plurality of the terminal receiving rooms 22 to receive the piercing terminals 3.

As shown in FIGS. 1 and 2, the locking hole 18 is formed from an outer surface of the main body 16, and is fitted into a locking projection (not shown) disposed in the mating connector housing.

As shown in FIGS. 1 and 5, the protrusion 19 is disposed at the outer surface of each side of the main body 16. The protrusions 19 are fitted into locking holes 35 of the cover 17 so as that the main body 16 and the cover 17 are locked to each other.

As shown in FIG. 2, the housing receiving room 20 is formed in the main body 16 along the direction of K. As shown in FIG. 2, the FFC receiving room 21 is disposed oppositely to the housing receiving room 20 and has a plurality of holding protrusions 24 and a pair of positioning grooves 23.

The holding protrusions 24 are upstanding from a bottom wall of the main body 16 and extends to the insertion direction K and juxtaposed to each other with the same distance as that between the conductors 5 of the FFC 2 and are flush along a direction of W. Top surfaces 25 support the FFC 2 received in the FFC receiving room 21.

Figure 6:
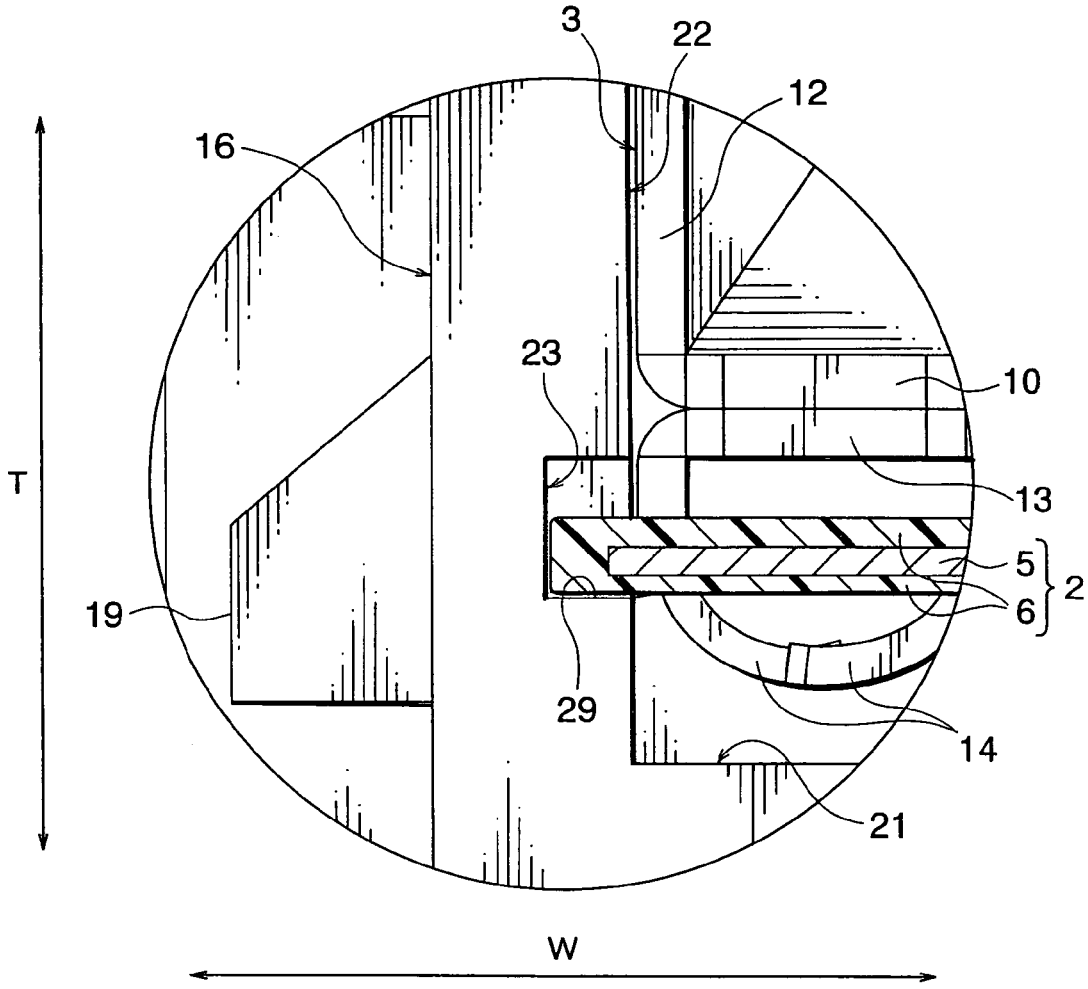
FIG. 6 is an expanded view of a positioning groove formed in a FFC receiving room of the connector housing of FIG. 5.

As shown in FIGS. 5 and 6, the pair of positioning grooves 23 are disposed at inner walls of the main body 16 and have resting surfaces 29 and extend into the direction of K. The resting surfaces 29 are flush with the top surfaces 25 of the holding protrusions 24. The positioning grooves 23 receive both ends of the FFC 2 of the direction of W and position the FFC 2 in company with the resting surfaces 29.

The plurality of the terminal receiving rooms 22 each have a partition wall 26 and a rear wall 27 and are communicated with the FFC receiving rooms 21 in a direction T of a thickness of the main body 16. The terminal receiving rooms 22 are separated from the housing receiving room 20 with the rear wall 27.

The plurality of the partition walls 26 partition the terminal receiving rooms 22 in the width direction W. The rear wall 27 has through holes 28, an inner wall of which has almost the same shape and size as an outer wall of the inserting tip 15 of the piercing terminal 3.

The each terminal receiving room 22 is communicated with the housing receiving room 20 with each through-hole 28. The piercing terminals 3 enter into the terminal receiving rooms 22. The inserting tips 15 pass through the through holes 28 and enter into the hosing receiving room 20 so as to be electrically connected with the female terminals of the mating connector housing.

As shown in FIGS. 1 and 5, the cover 17 has hinges 30 and a supporting wall 31. When the cover 17 is fitted into the main body 16, the piercing terminal 3 is covered with the cover 17 and main body 16.

Figure 7:
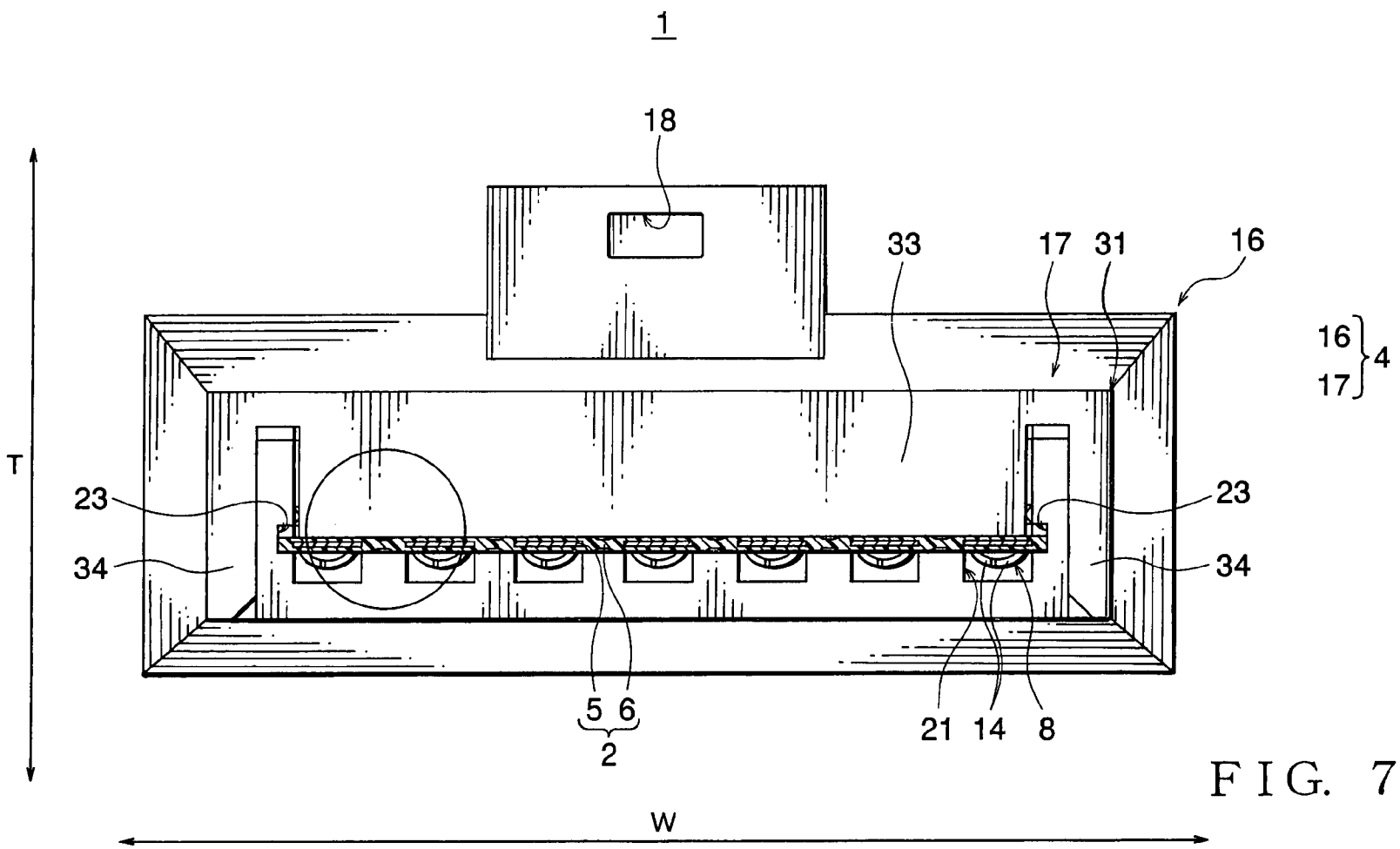
FIG. 7 is a sectional view taken along the line 7-7 of FIG. 1.

The hinges 30 have a thickness thinner than those of the main body 16 and supporting wall 31 and are self-hinge to be rotatably connected to the main body 16 and supporting wall 31. The hinges 30 open and close the cover 17 as shown in FIG. 5 and FIG. 7, respectively.

As shown in FIGS. 1, 2 and 5, the supporting wall 31 has an L-shaped section, and has an upper cover 32 connected with the hinges 30 and a front cover 33 communicated with the upper cover 32.

As shown in FIG. 1, the upper cover 32 has a rectangular shape and a pair of side covers 34 disposed at both sides of the supporting wall 31 in the direction W. The pair of the side covers 34 are formed in a rectangular shape and have the locking holes 35 with which the protrusions 19 lock the main body 16 and the cover 17.

As shown in FIGS. 1 and 2, the front cover 33 is disposed apart from the hinges 30. When the main body 16 and the cover 17 are fitted together, an inner wall 36 of the front cover 33 abuts to ends of the piercing terminals 3 opposite to the inserting tips 15. A distance H between the front cover 33 and the rear wall 27 is formed as almost the same as a longitudinal length L of the tubes 7 of the piercing terminals 3.

Accordingly, the inner wall 36 of the front cover 33 prevents the piercing terminals 3 from being pulled out of the terminal receiving rooms 22.

When the piercing terminals 3 are not completely fitted into the housing receiving room 20 and terminal receiving rooms 22, a distal end 37 of the front cover 33 abuts to the top walls 11 of the piercing terminals 3 when the front cover 33 is closed. The supporting wall 31, or the cover 17 can not be fitted into the main body 17 when the piercing terminals 3 are not completely inserted into the terminal receiving rooms 22.

Figure 8:
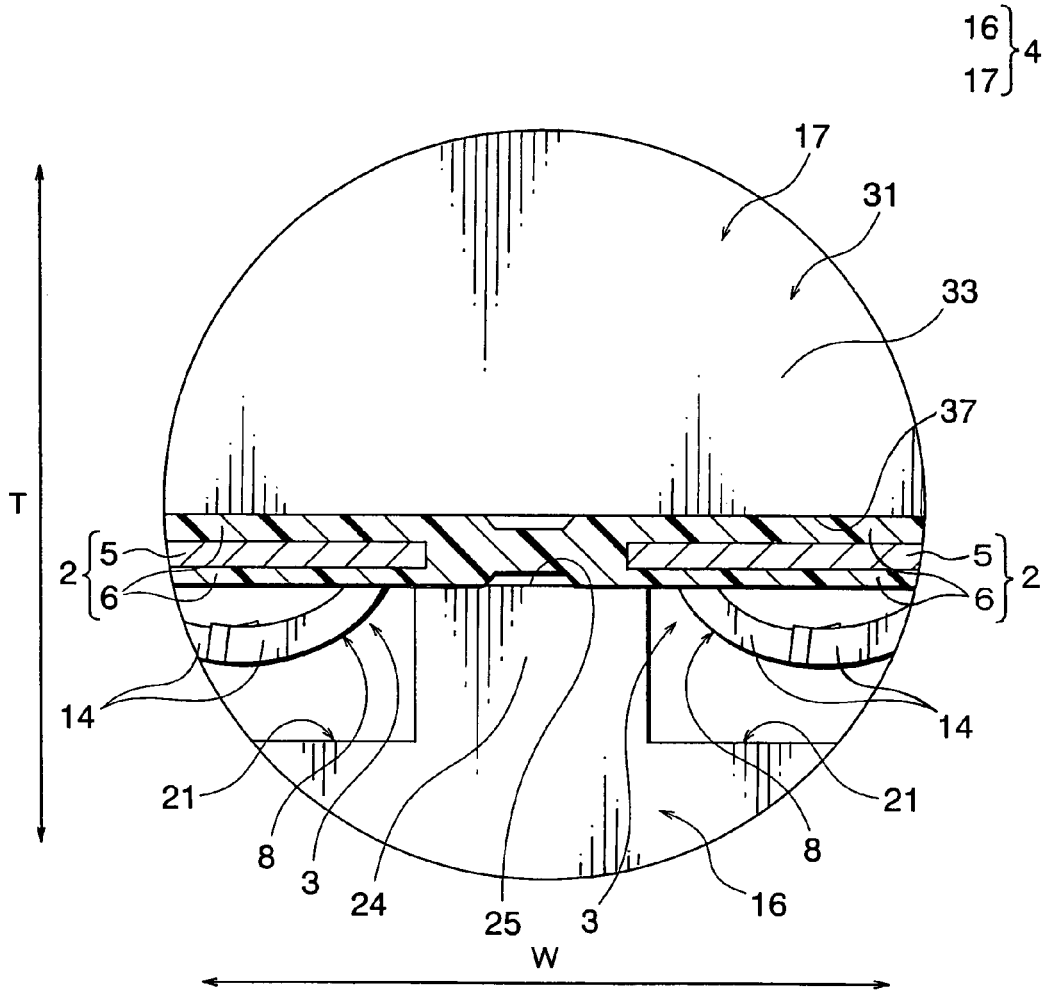
FIG. 8 is an expanded view showing that a cover of FIG. 7 sandwiches the FFC with a top surface of a holding protrusion of a main body.

When the piercing terminals 3 completely enter into the terminal receiving rooms 22, and the cover 17 and the main body 16 are fitted together, as shown in FIGS. 7 and 8, the distal end 37 sandwiches the FFC 2 between the resting surface 29 of the positioning groove 23 and the top surface 25 of the holding protrusion 24 and locks the FFC 2.

Accordingly, the distal end 37 serves as a fitting detector which detects an incomplete fitting of the piercing terminals 3 into the terminal receiving rooms 22. The fitting detector prevents the cover 17 from being fitted into the main body 16 when it detects the incomplete fitting of the piercing terminals 3.

The distal end 37 of the front cover 33 locks the FFC 2. The inner wall 36 of the front cover 33 locks the ends of the piercing terminals 3 opposite to the inserting tips 15. Accordingly, the distal end 37 and inner wall 36 of the front cover 33 serve as a double locking portion.

Figure 9:
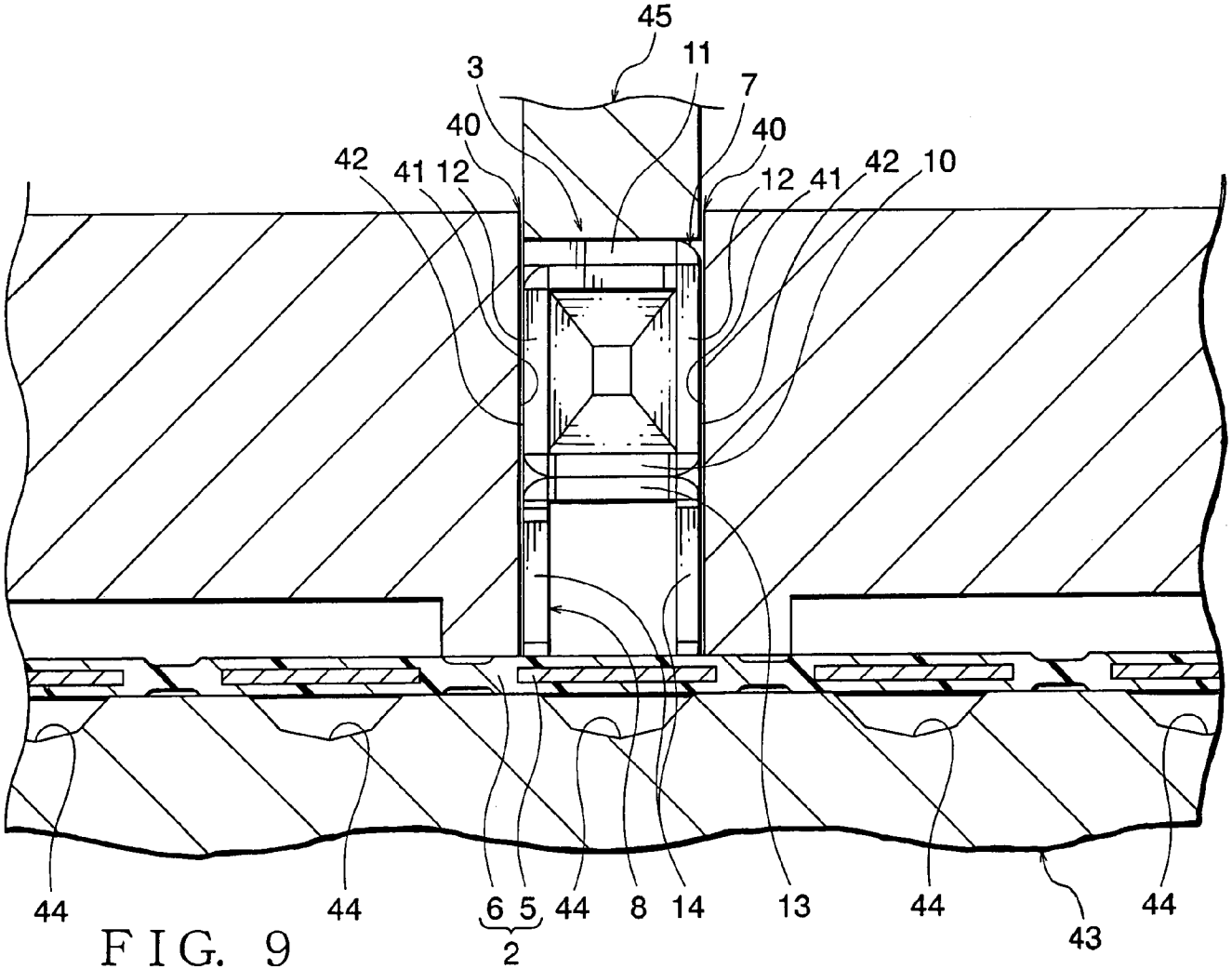
FIG. 9 is a sectional view showing that the piercing terminal is placed between a pair of frames and approached to the FFC.

A step for crimping the FFC 2 with the piercing terminals 3 is explained. As shown in FIG. 9, the conductors 5 of the FFC 2 are superimposed on recesses 44 formed at a surface of a holder 43. The both side walls 12 of each piercing terminal 3 are positioned between a pair of frames 40 and the crimp edges 14 are approached and abutted to the FFC 2.

A pressing portion 45 is abutted to the top wall 11 of the tube 7 of the piercing terminal 3 and pushed toward the holder 43 while outer walls 42 of the piercing terminal 3 are opposing to inner walls 41 of the pair of frames 40. As a result, the crimp edges 14 penetrate the conductor 5 and the insulating sheet 6 of the end portion of the FFC 2.

Figure 10:
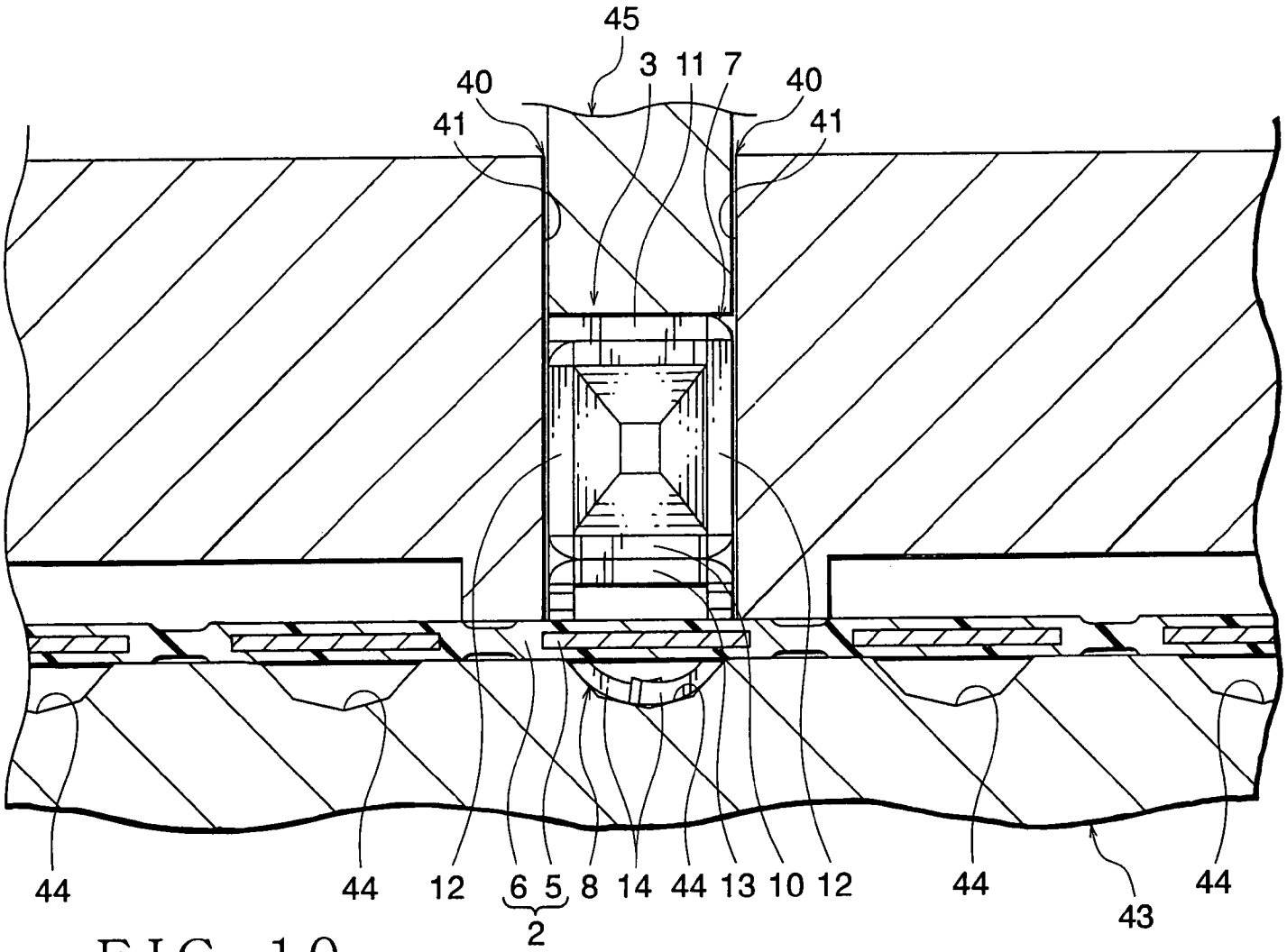
FIG. 10 is a sectional view showing that the piercing terminal is electrically connected to the conductor of the FFC.

The pressing portion 45 is further pushed toward the holder 43 so that the end portions of the crimp edges 14 are bent toward the base plate 13 along a surface of the recess 44, as shown in FIG. 10. Accordingly, both the crimp edges 14, or the piercing terminal 3, and the conductor 5 of the FFC 2 are electrically connected and fixed together.

When the piercing terminal 3 is placed between the pair of the frames 40, gaps A' appear between the inner walls 41 of the frames 40 and the outer walls 42 of the piercing terminal 3. These gaps A' cause an inclination θ' of the crimp edges 14 with respect to the vertical position, as schematically shown in FIG. 11B.

Figure 12:
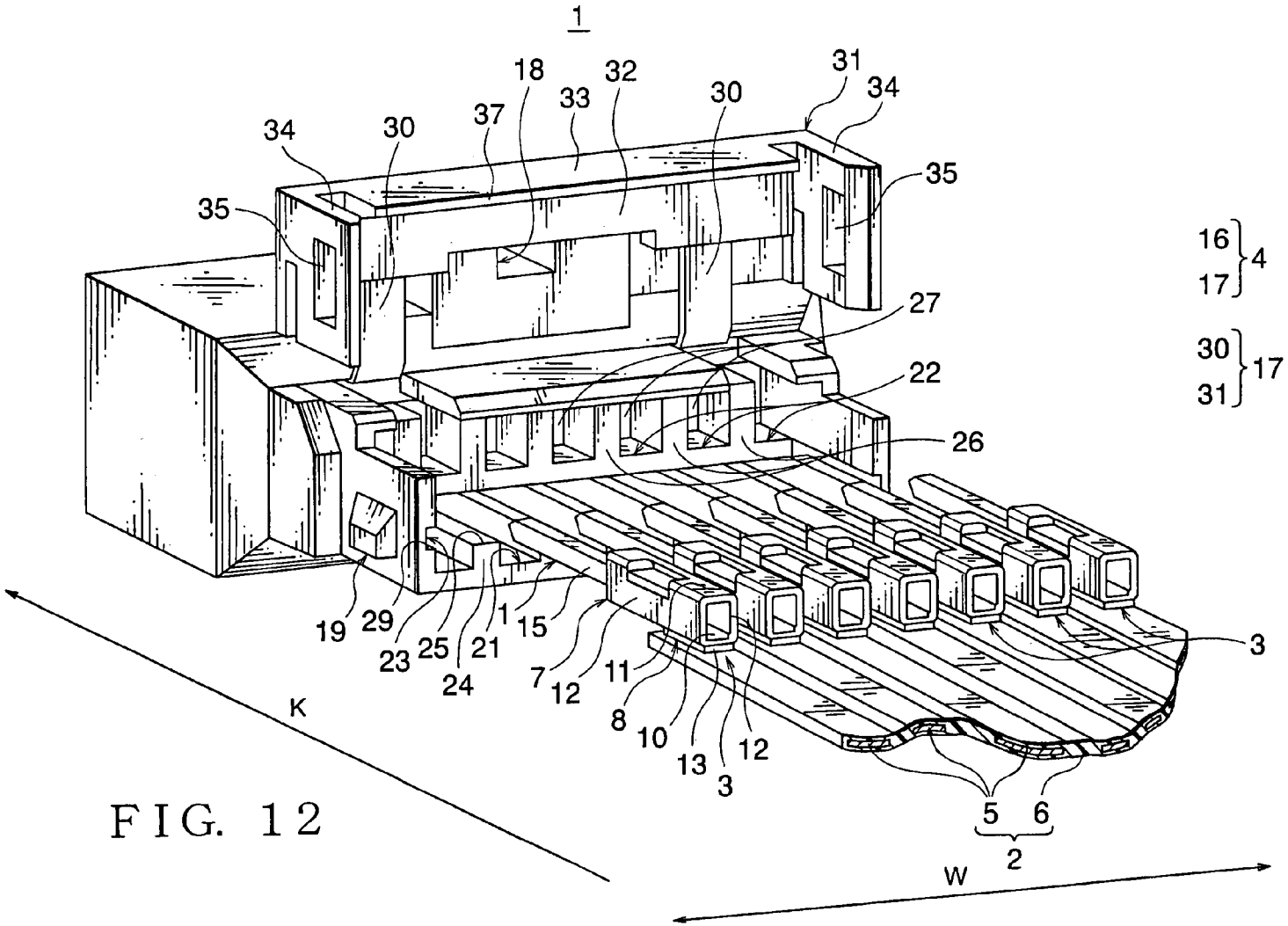
FIG. 12 is a perspective view showing that the piercing terminals connected with the FFC is approached to the connector housing.
Figure 13:
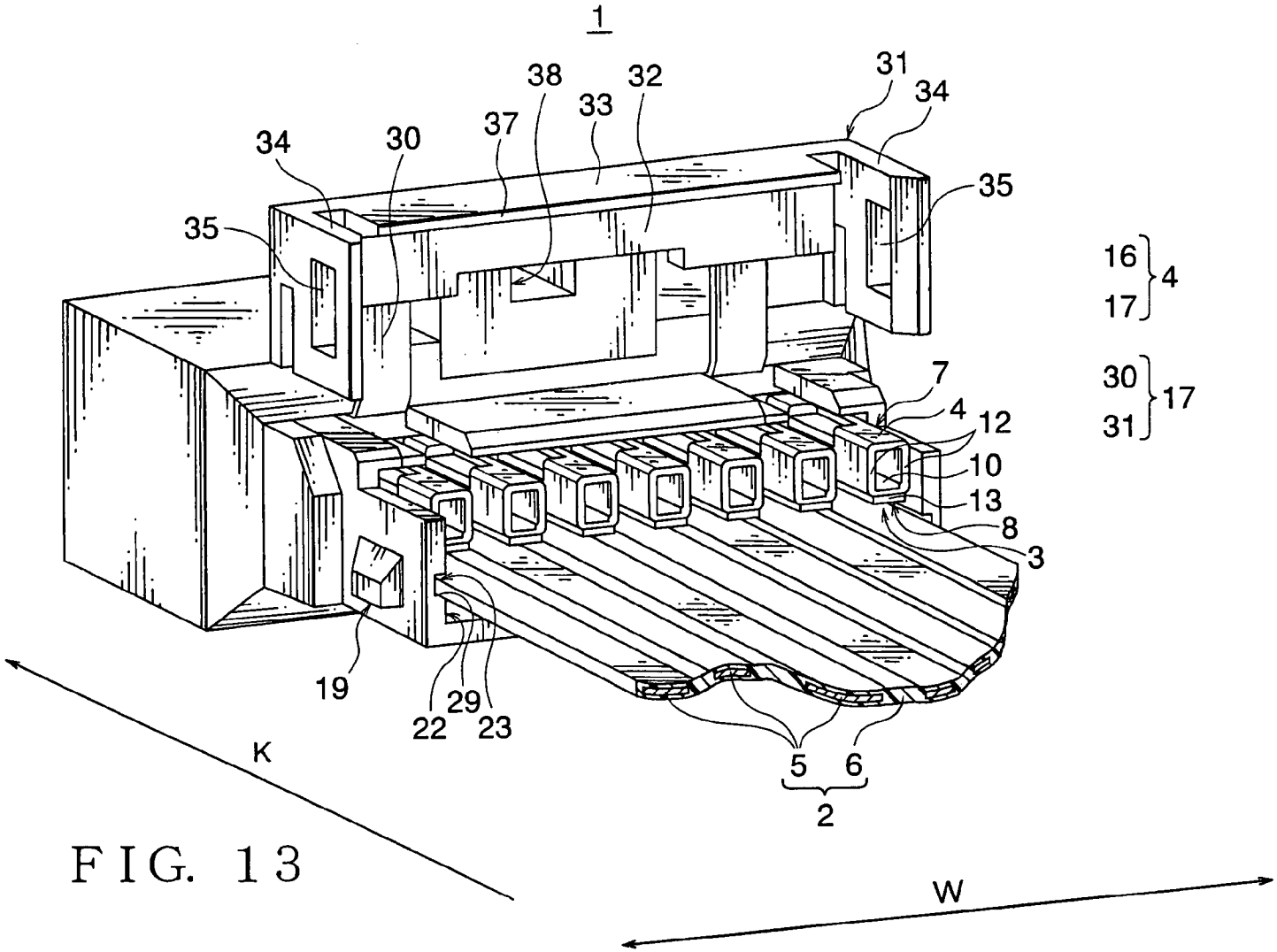
FIG. 13 is a perspective view showing that the piercing terminals enter into terminal receiving rooms of the connector housing.

An explanation how to insert the piercing terminals 3 and the crimped end portion of the FFC 2 into the connector housing 4 is given. As shown in FIGS. 12 and 13, the cover 17 is opened and the piercing terminals 3 crimping the FFC 2 are inserted into the terminal receiving rooms 22 so as that the FFC 2 enters into the FFC receiving room 21. The resting surfaces 29 of the pair of the positioning grooves 23 and the top surfaces 25 of the holding protrusions 24 position the FFC 2 into the FFC 2 receiving room 21. Hence, the piercing terminals 3 crimping the FFC 2 are received in the connector housing 4.

In this embodiment, the crimp edges 14 extend outwardly from the outer surface of the tube 7. It is not necessary to dispose the crimp edges 14 at an end of the tube 7 so that the piercing terminal 3 can be shorter. Since the piercing terminals 3 extend less from the end portion of the FFC 2 than the conventional terminal, handling of the FFC 2 becomes easy.

Figure 11B:
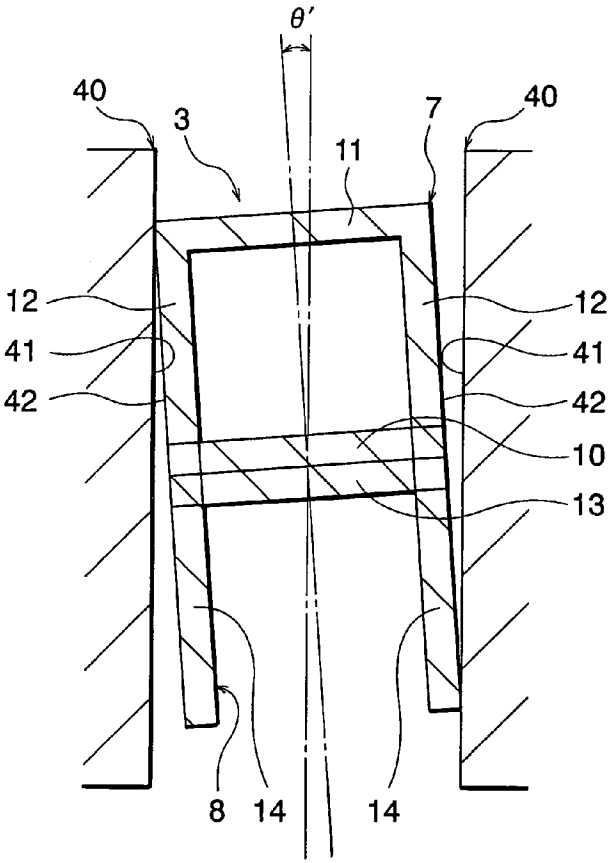
FIG. 11B is a sectional view showing that the piercing terminal between the frames is inclined.
Figure 11A:
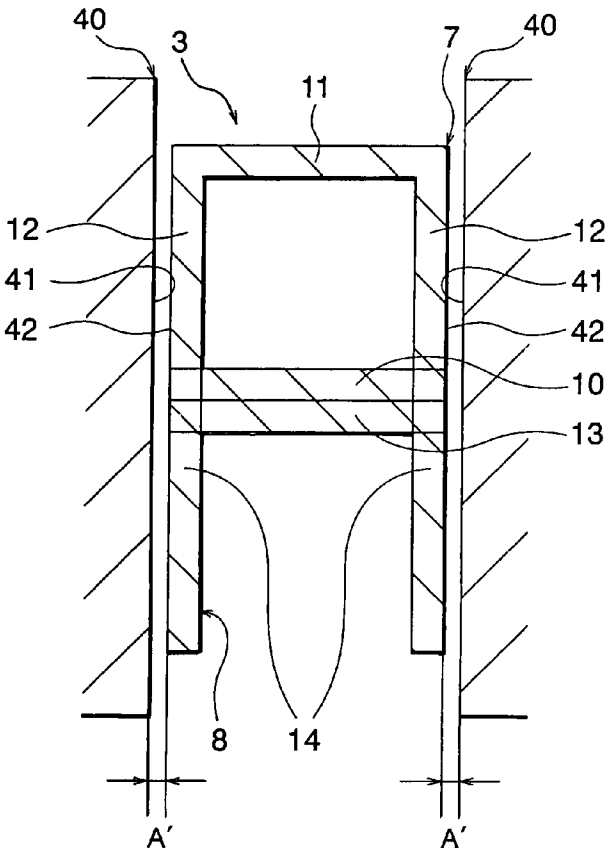
FIG. 11A is a sectional view showing that the piercing terminal between the frames is positioned vertically.
Figure 23B:
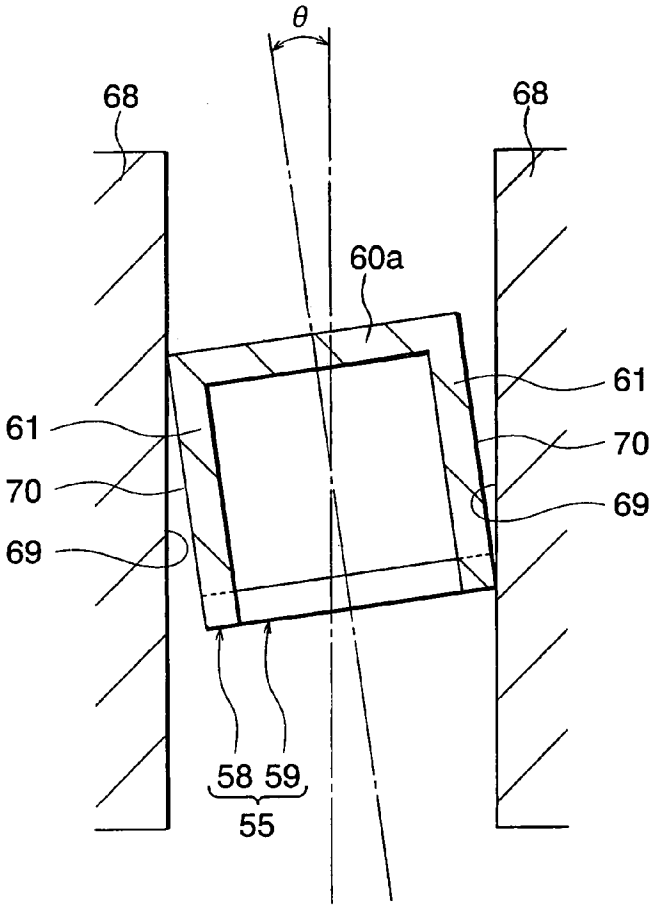
PRIOR ART FIG. 23B
FIG. 23B is a sectional view showing that the conventional terminal is inclined between the frames.
Figure 23A:
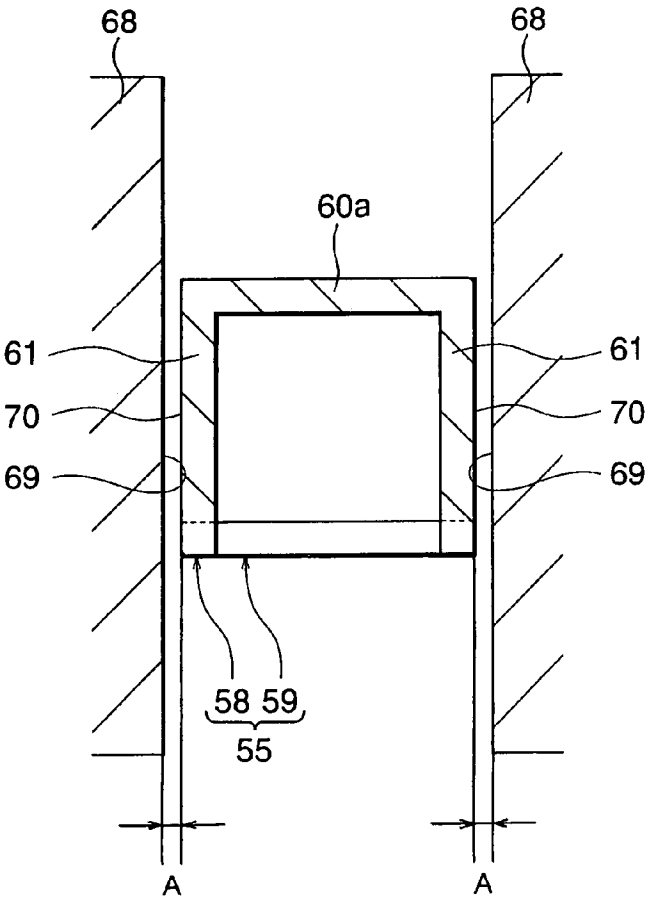
PRIOR ART FIG. 23A
FIG. 23A is a sectional view showing that the conventional terminal is placed vertically between a pair of frames.

As shown in FIGS. 11A and 11B, since the crimp edges 14 extend outwardly from the outer surface of the tube 7, a height of the piercing terminal 3, or a thickness of the tube 7 plus a height of the crimp edges 14, of the present invention becomes higher than that of the conventional terminal as shown in FIGS. 23A and 23B. This results in that the inclination angle θ' becomes smaller than the inclination angle θ so that the piercing terminals 3 penetrate vertically to the FFC 2 and assure the electrical connection with the conductors 5 of the FFC 2. The piercing terminal 3 of the present invention improves reliability of the connection with the FFC 2.

Since the piercing terminals 3 have a shorter extension from the end portion of the FFC 2, the piercing terminals are easily received in the terminal receiving rooms 22.

The piercing terminals 3 are fully covered with the connector housing 4 and the cover 17 and isolated from outside so that the reliability of the electrical connection is improved.

When the piercing terminals 3 are received incompletely in the terminal receiving rooms 22, the cover 17 interferes with the piercing terminals 3 when the cover 17 is closed. Hence, the distal end 37 of the front cover 33 serves as the fitting detector.

When the cover 17 is fitted into the main body 16, the inner wall 36 and the distal end 37 prevent the piercing terminals 3 from being pulled out of the terminal receiving rooms 22. Hence, the inner wall 36 and the distal end 37 serve as the double locking portion.

Both the FFC receiving room 21 and terminal receiving rooms 22 are communicated each other so that the piercing terminals 3 crimping the FFC 2 can enter into the connector housing 4. Accordingly, a trimming for the FFC 2 and the connector housing 4 to be fitted together is not necessary so that the strength and the reliable connection thereof are kept.

Figure 14:
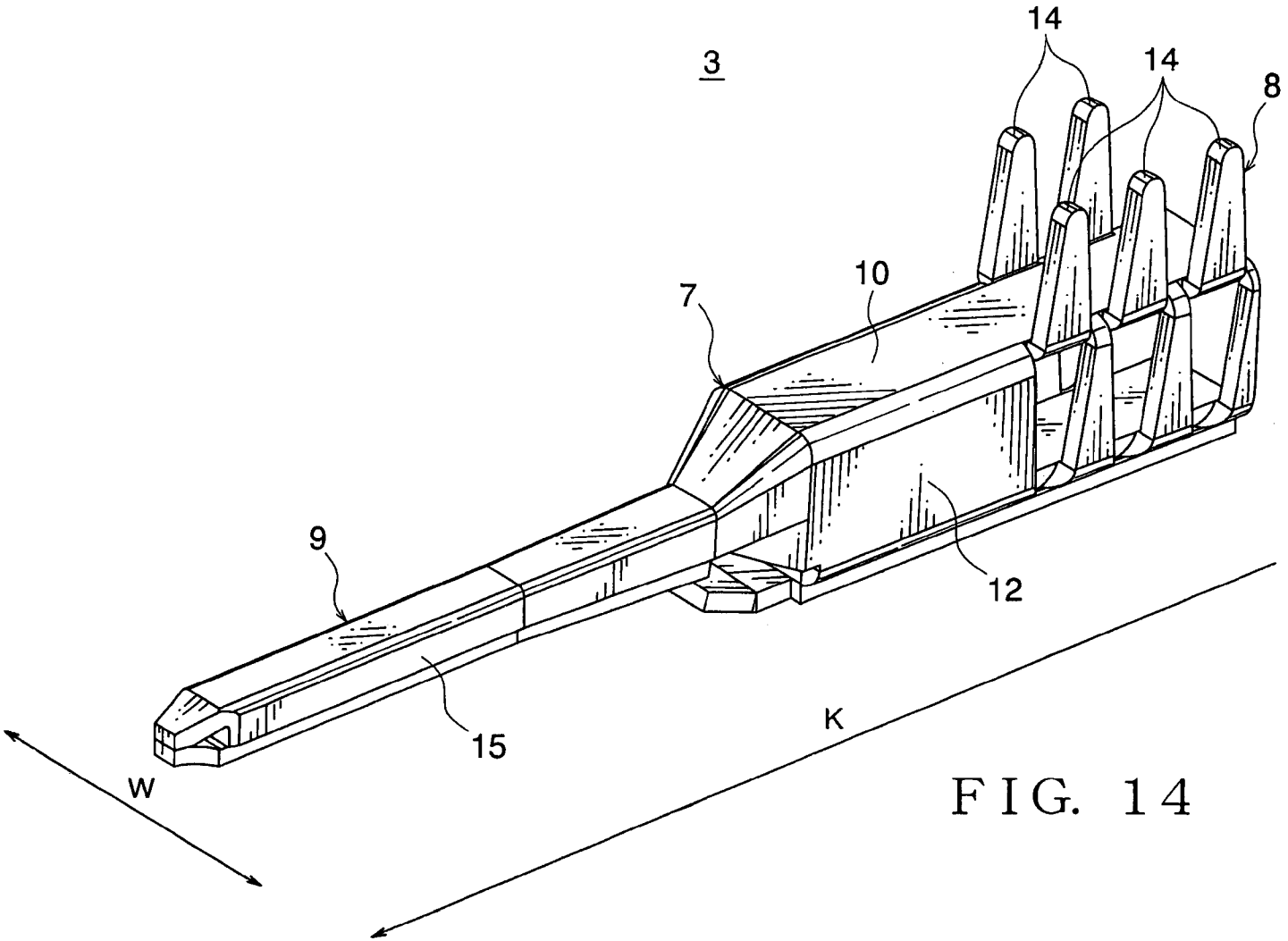
FIG. 14 is a perspective view of a second embodiment of a piercing terminal of the present invention.
Figure 15:
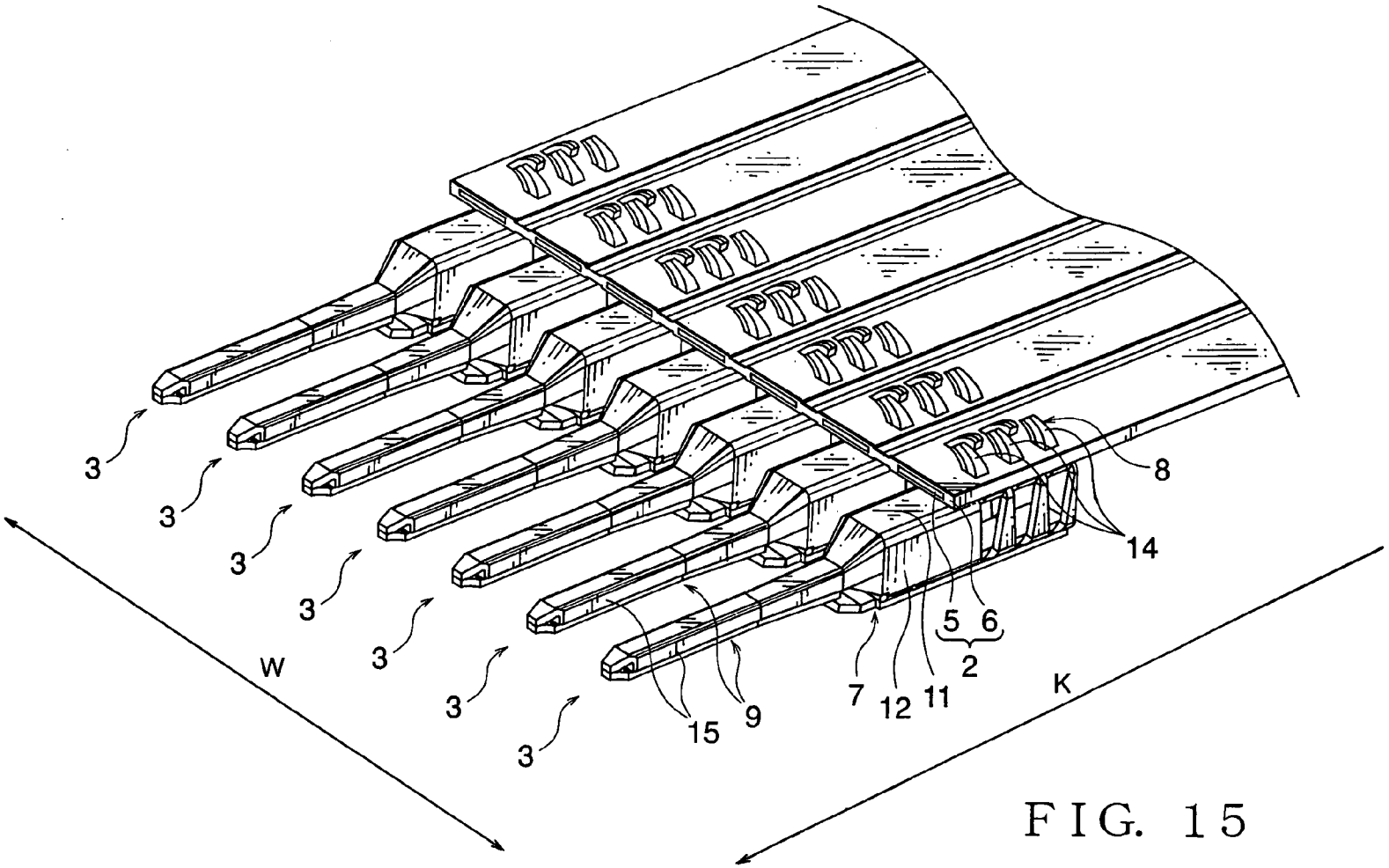
FIG. 15 is a perspective view showing that the piercing terminals of FIG. 14 are connected with conductors of a FFC.

FIG. 14 shows a second embodiment of a piercing terminal 3 of the present invention. Crimp edges 14 are formed by cutting out of side walls 12 of a tube 7 and being bent with respect to edges of the tube 7 to 180 degrees. The crimp edges 14 extend outwardly from the outer surface of the tube 7. The piercing terminal 3 of FIG. 14 crimp a FFC 2 as shown in FIG. 15.

The crimp edges 14 are formed integrally with the piercing terminal 3 so that a number of parts of the piercing terminal 2 decreases and the material yield thereof improves. This formation makes the piercing terminal 3 shorter similarly to the first embodiment.

Figure 16:
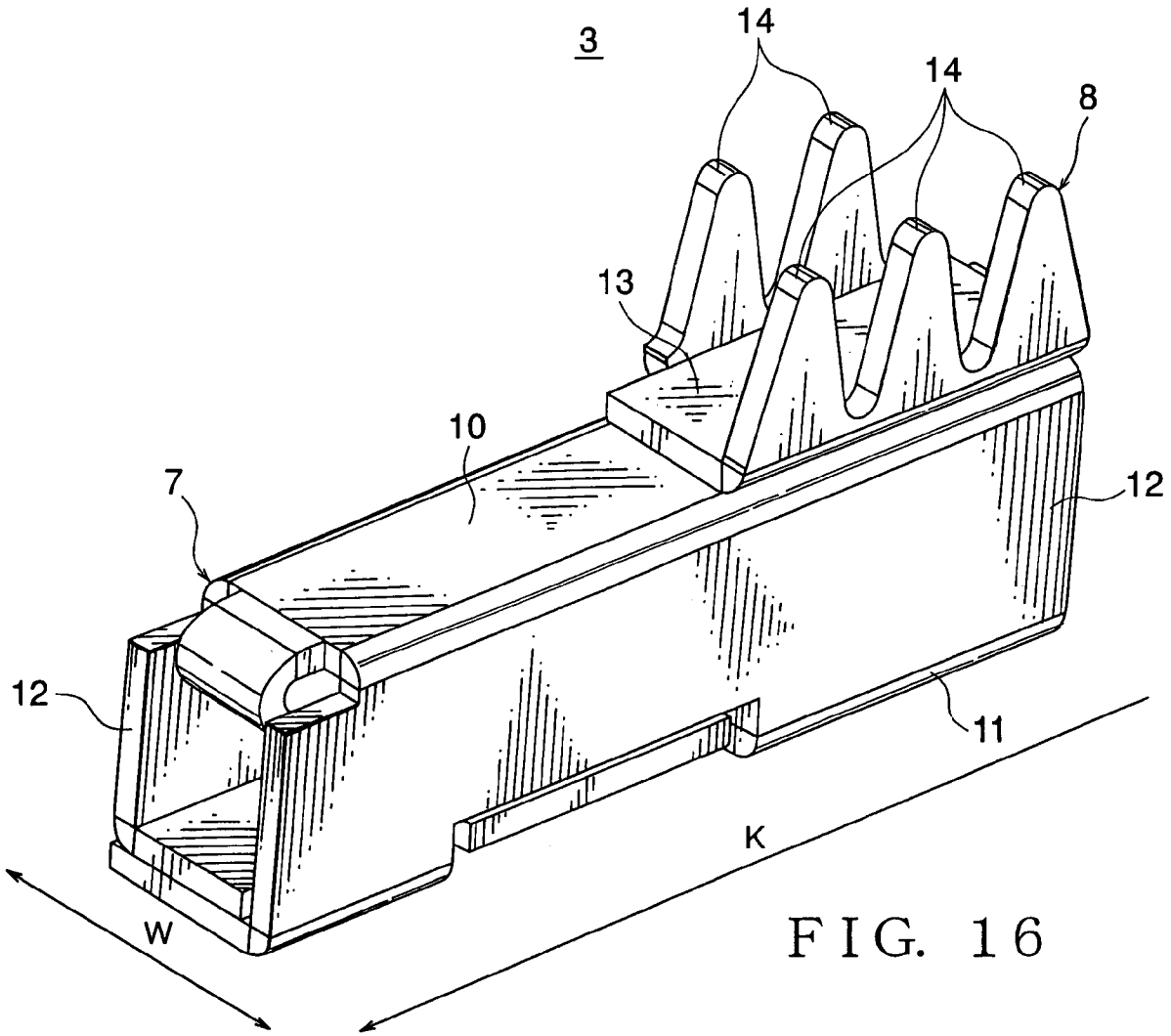
FIG. 16 is a perspective view of a third embodiment of a piercing terminal of the present invention.
Figure 17:
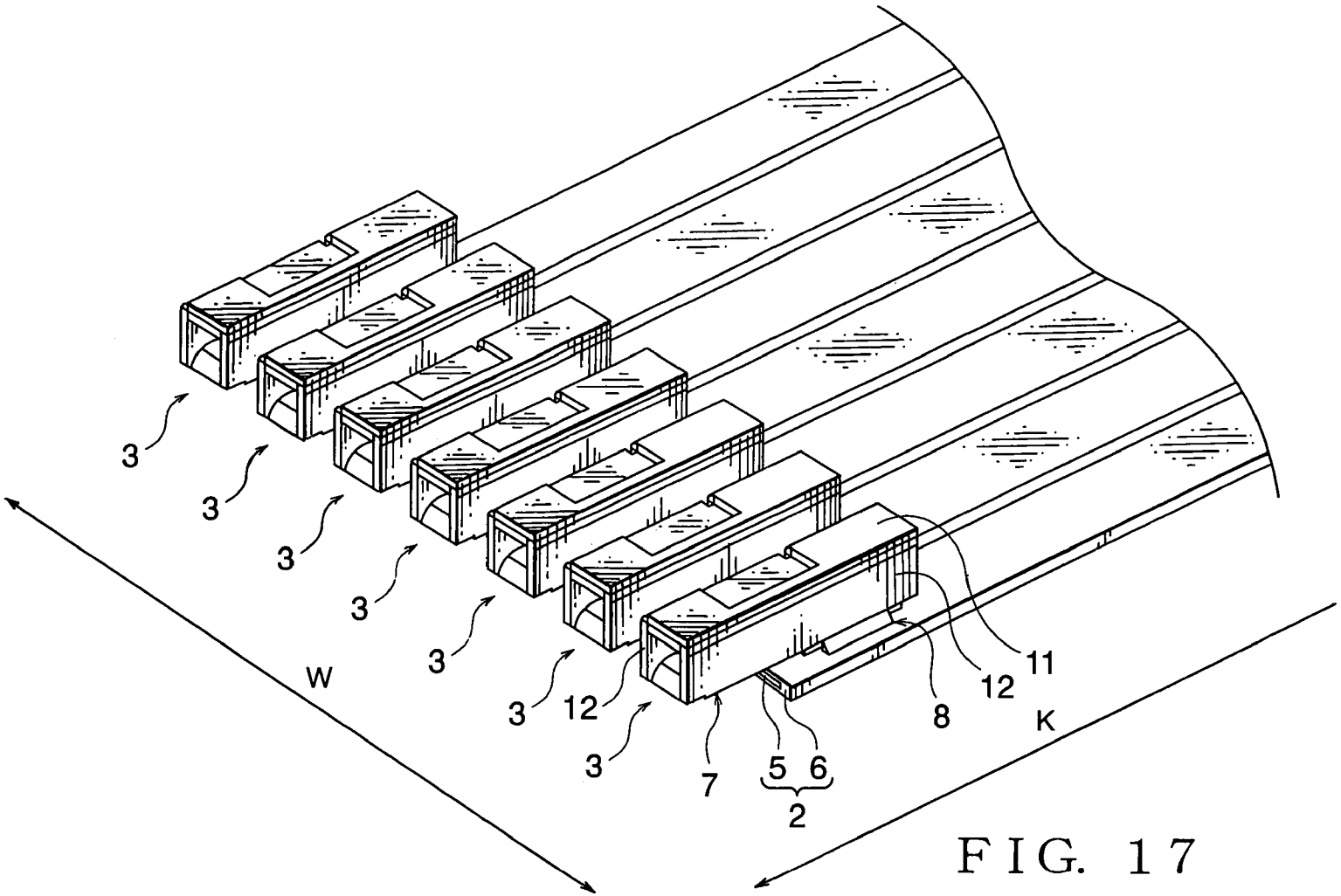
FIG. 17 is a perspective view showing that the piercing terminals of FIG. 16 are connected with conductors of a FFC.
Figure 18:
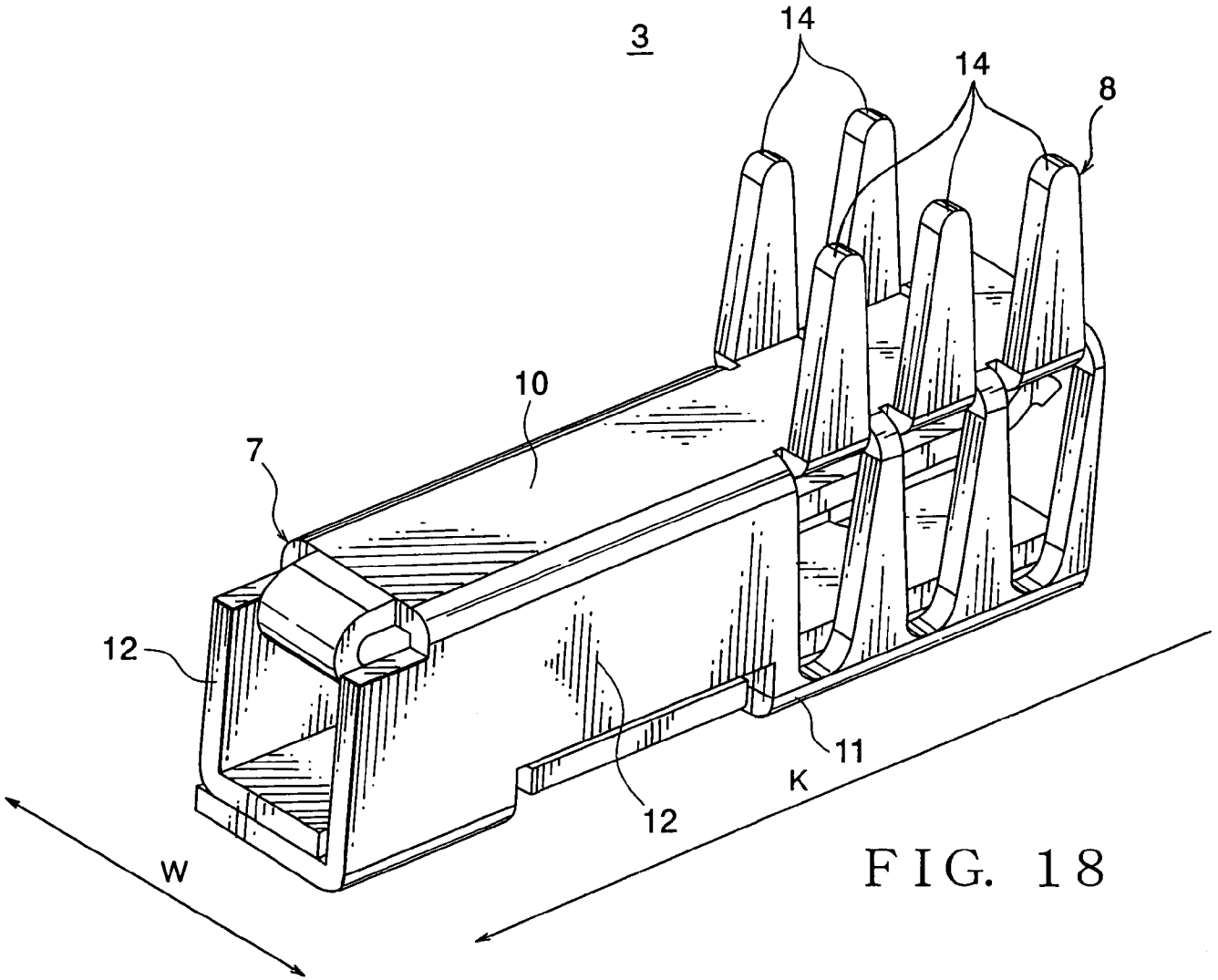
FIG. 18 is a perspective view of a fourth embodiment of a female-type piercing terminal of the present invention.
Figure 19:
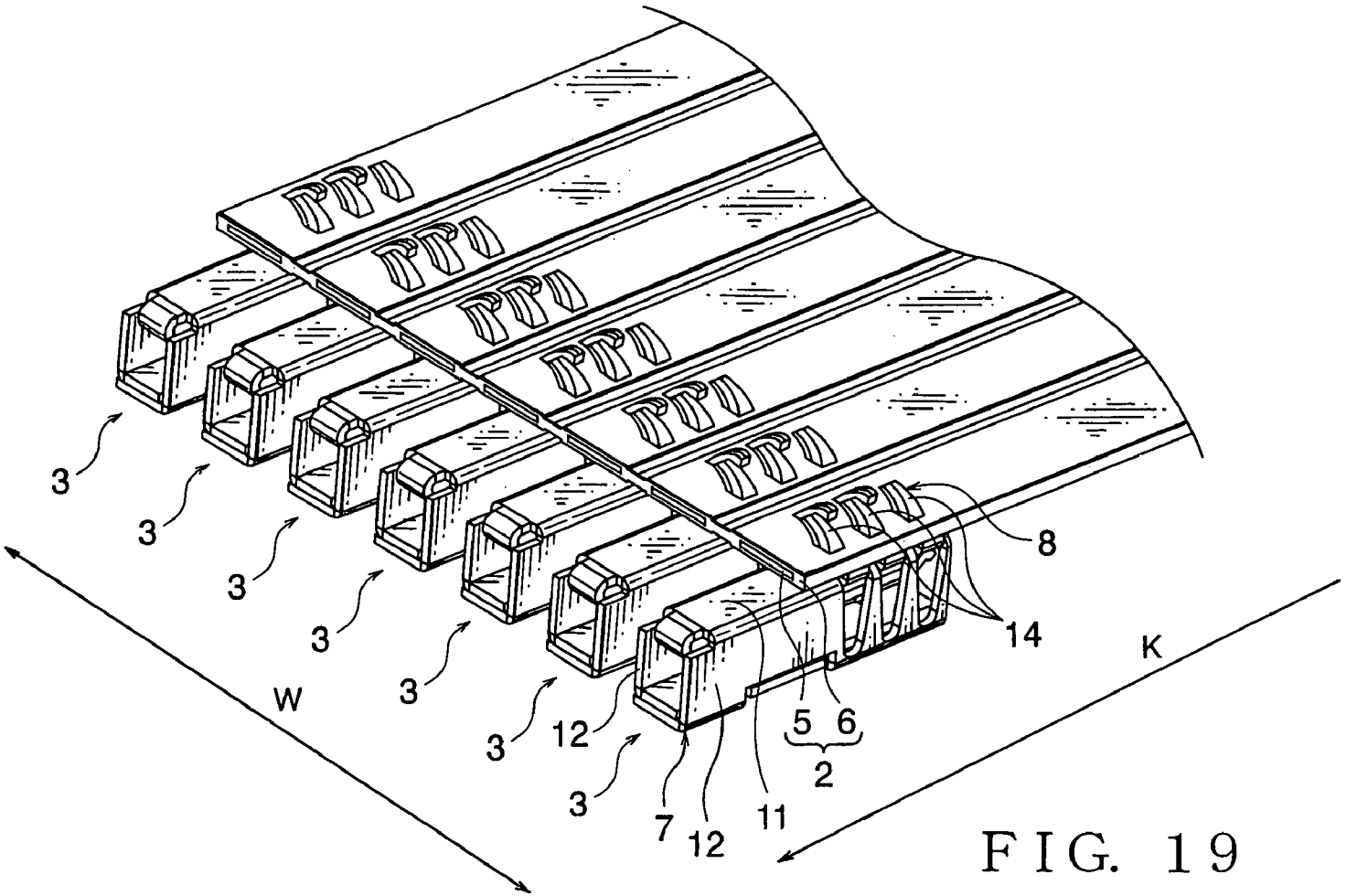
FIG. 19 is a perspective view showing that the piercing terminals of FIG. 18 are connected with conductors of a FFC.
Figure 20A:
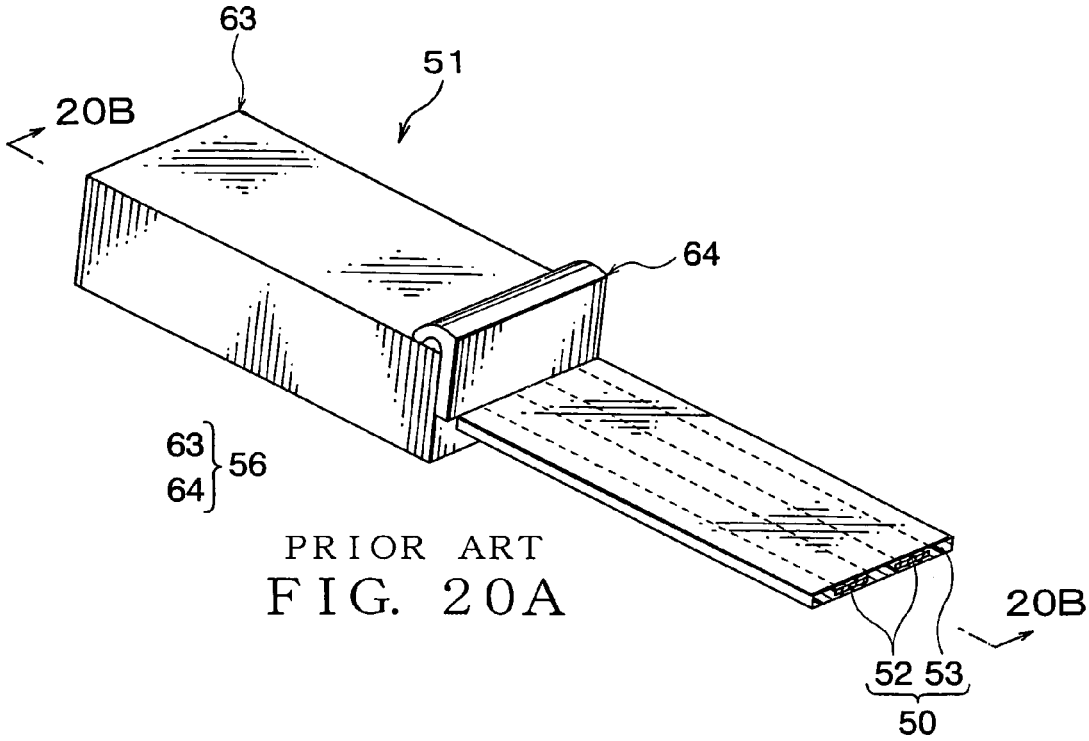
PRIOR ART FIG. 20A
FIG. 20A is a perspective view of a conventional connector connected with a FFC.
Figure 20B:
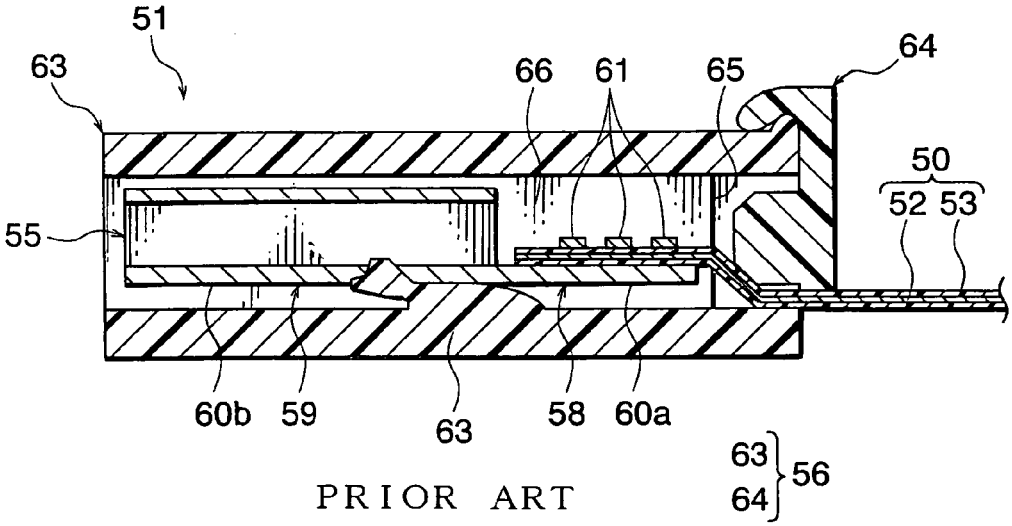
PRIOR ART FIG. 20B
FIG. 20B is a sectional view taken along the line 20B-20B of FIG. 20A.
Figure 21A:
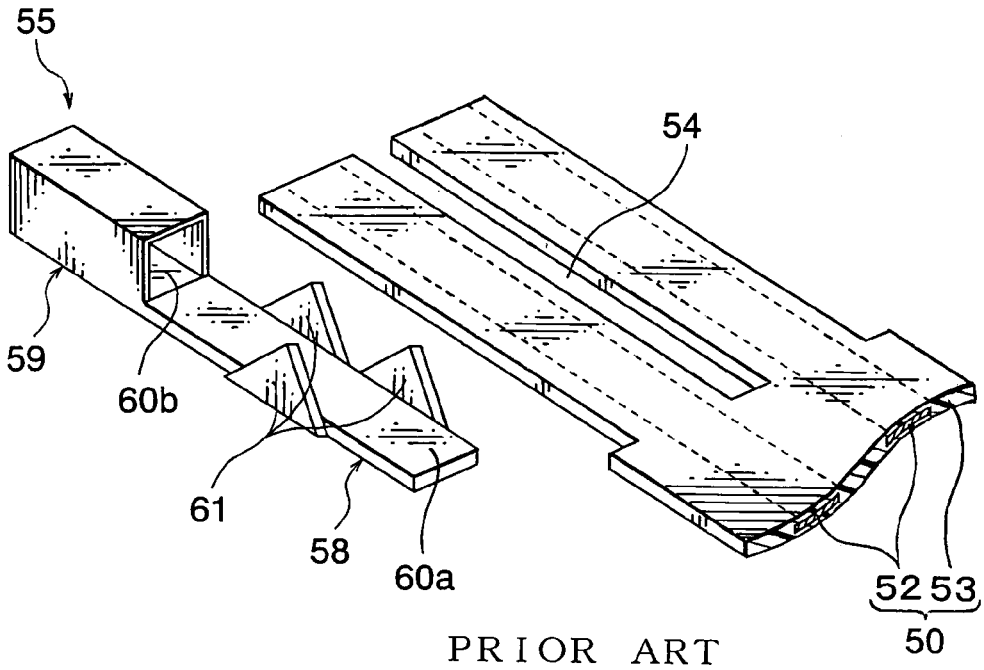
PRIOR ART FIG. 21A
FIG. 21A is a perspective view prior to a female terminal is connected to the FFC in the conventional connector.
Figure 21B:
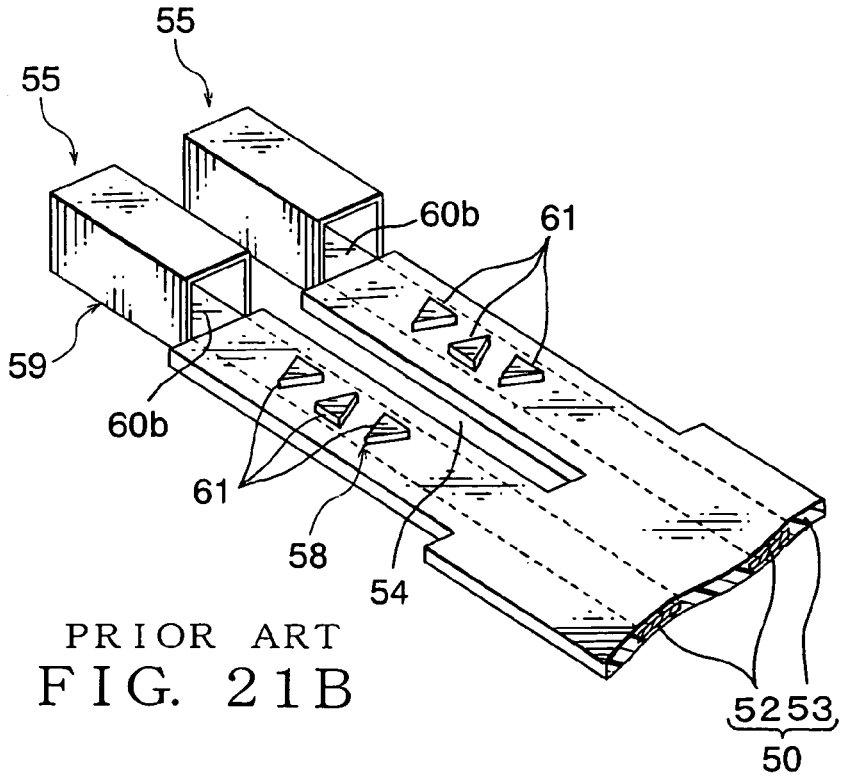
PRIOR ART FIG. 21B
FIG. 21B is a perspective view after the female terminals are connected to the FFC.
Figure 22:
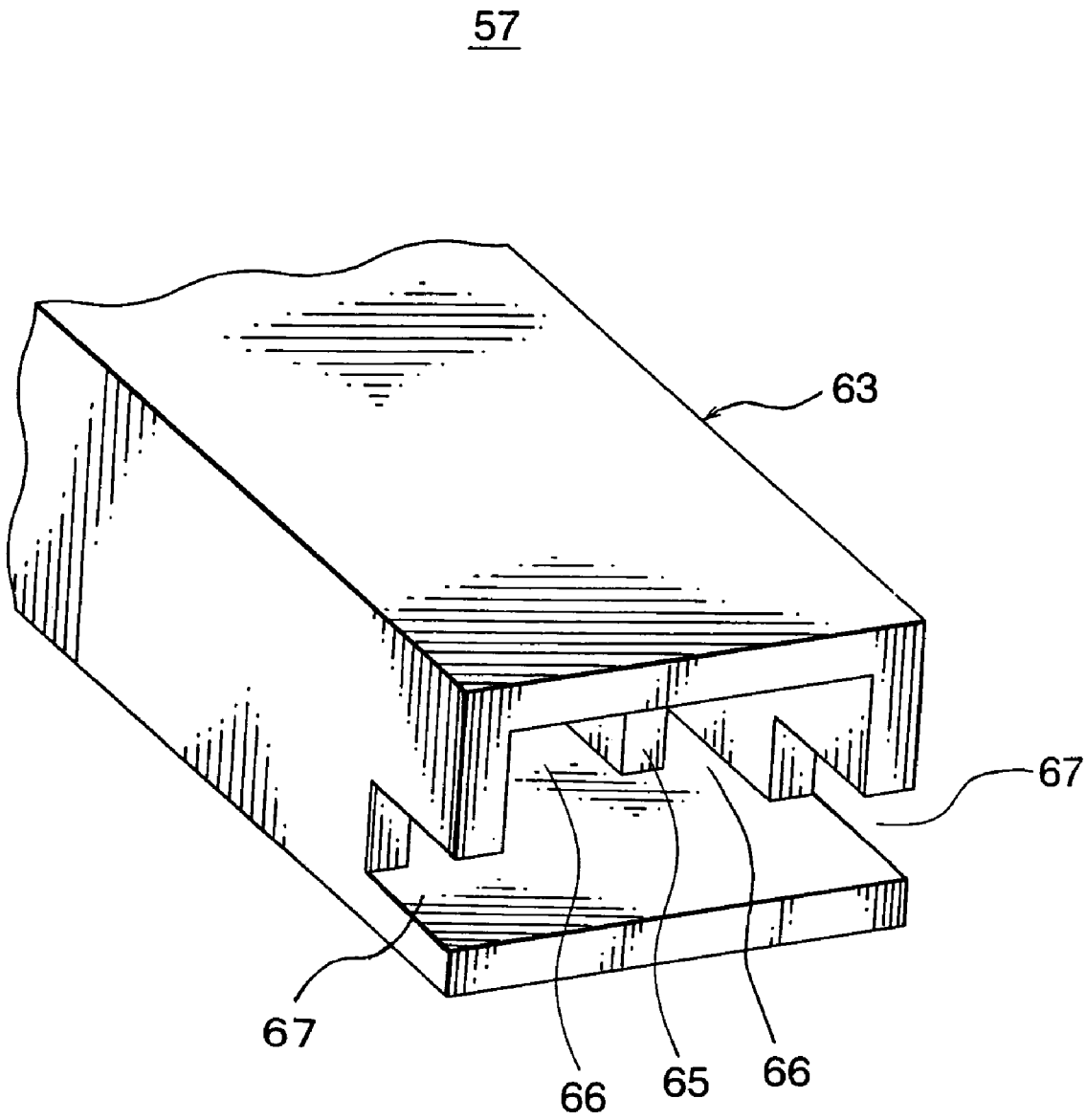
PRIOR ART FIG. 22
FIG. 22 is a perspective view of a connector housing of another conventional connector.

FIGS. 16 and 18 show a third and fourth embodiment, respectively. The embodiments disclosed are adapted to the male type piercing terminals 3. However, as shown in FIGS. 16-19, the present invention can also be adapted to female-type piercing terminals 3. As shown in FIGS. 16 and 18, the electric contact portions 9 having the inserting tips 15 are replaced with the tubes 7. The same reference signs used the above mentioned embodiments are omitted for explanation of drawings below.

As shown in FIG. 16, in the third embodiment, crimp edges 14 can be disposed on any places of a bottom wall 10. As shown in FIG. 18, in the fourth embodiment, crimp edges 14 can be formed from any places of side walls 12. Any number and shape of the upstanding crimp edges 14 can be formed on the bottom wall 10.

The embodiments of the present invention described are only exemplary and not limited thereto. Any modifications are possible without departing from the scope of the invention as set forth herein.

What is claimed is:

1. A connector comprising: a connector housing having a terminal receiving room; and a piercing terminal, received in the terminal receiving room, for electrically connecting with a conductor of a flat circuit body, said piercing terminal comprising:

an elongated tube having a lengthwise direction for alignment with a lengthwise direction of the conductor; and a crimp edge to be electrically connected to the conductor of the flat circuit body, wherein said crimp edge protrudes outwardly in a direction perpendicular to the lengthwise direction from an outer surface of the tube; wherein said connector housing includes a main body for receiving the piercing terminal in the terminal receiving room, and a cover to be fitted to the main body and cover the piercing terminal in company with the main body; and said cover has a double locking portion which prevents the piercing terminal from being pulled out of the terminal receiving room after the cover is fitted into the main body.

2. The piercing terminal as claimed in claim 1, wherein said crimp edge is formed by cutting out of the tube and bending from it outwardly.

3. The connector as claimed in claim 1, wherein said cover has a fitting detector which detects an incomplete fitting of the piercing terminal into the terminal receiving room and interferes with the piercing terminal so as to prohibit the fitting.

4. The connector as claimed in claim 1, wherein said connector housing has a flat circuit body receiving room communicating with the terminal receiving room.

5. The connector as claimed in claim 2, wherein said cover has a fitting detector which detects an incomplete fitting of the piercing terminal into the terminal receiving room and interferes with the piercing terminal so as to prohibit the fitting.

6. The connector as claimed in claim 2, wherein said connector housing has a flat circuit body receiving room communicating with the terminal receiving room.

7. The connector as claimed in claim 3, wherein said connector housing has a flat circuit body receiving room communicating with the terminal receiving room.

8. The connector as claimed in claim 5, wherein said connector housing has a flat circuit body receiving room communicating with the terminal receiving room.

* * * * *